US006443557B1

(12) United States Patent
Pan et al.

(10) Patent No.: US 6,443,557 B1
(45) Date of Patent: Sep. 3, 2002

(54) CHIP-CARRIER FOR IMPROVED DROP DIRECTIONALITY

(75) Inventors: Alfred I-Tsung Pan, Sunnyvale, CA (US); Marshall Field, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/430,329

(22) Filed: Oct. 29, 1999

(51) Int. Cl.[7] ..... B41J 2/14
(52) U.S. Cl. ..... 347/47; 347/63
(58) Field of Search ..... 347/8, 46, 47, 347/71, 54, 63, 68, 87; 346/1.1; 428/131

(56) References Cited

U.S. PATENT DOCUMENTS

| | | | | |
|---|---|---|---|---|
| 4,894,664 A | | 1/1990 | Tsung Pan | 346/1.1 |
| 4,922,265 A | | 5/1990 | Pan | 346/1.1 |
| 5,350,616 A | | 9/1994 | Pan et al. | 428/131 |
| 5,455,613 A | | 10/1995 | Canfield et al. | 347/65 |
| 5,467,115 A | * | 11/1995 | Childers | 347/47 |
| 5,812,163 A | | 9/1998 | Wong | 347/68 |
| 5,818,478 A | * | 10/1998 | Gibson | 347/45 |
| 5,847,725 A | | 12/1998 | Cleland et al. | 347/20 |
| 5,861,902 A | | 1/1999 | Beerling | 347/63 |
| 6,257,706 B1 | * | 7/2001 | Ahn | 347/54 |

* cited by examiner

*Primary Examiner*—Lamson D. Nguyen
(74) *Attorney, Agent, or Firm*—Trueman H. Denny, III

(57) ABSTRACT

A carrier frame having an aperture and a nozzle plate disposed on the carrier frame and positioned over the aperture is described. The nozzle plate has at least one nozzle formed between opposing surfaces of the nozzle plate. The carrier frame and the nozzle plate are made from materials having dissimilar thermal expansion coefficients such that the carrier frame has a thermal expansion coefficient that is less than the thermal expansion coefficient of the nozzle plate. The nozzle plate is staked to the carrier frame and then baked so that the nozzle plate shrinks during the baking process thereby becoming taught and under a state of tensile stress. The nozzle is formed in the nozzle plate after the baking process by laser ablation, for example. The nozzle thus formed has a true bore due to the taught nozzle plate and the opposed surfaces of the nozzle plate being parallel to each other. Consequently, a nozzle camber angle measured relative to a nozzle axis and defined by an angular displacement between a center point of symmetry on an input side of the nozzle and a center point of symmetry on an output side of the nozzle is coaxially aligned with the nozzle axis. By eliminating dimples in the nozzle plate, the nozzle has sidewall surfaces that are symmetric with respect to the nozzle axis thereby defining a nozzle with a true bore. An ink drop injected into the nozzle by an ink jet printhead mounted to the nozzle plate and having a firing chamber in fluid communication with the nozzle will exit the nozzle in a direction that is aligned with the nozzle camber angle such that the drop directionality of the ink drop is improved by true bore of the nozzle.

35 Claims, 10 Drawing Sheets

CHIP-CARRIER FOR IMPROVED DROP DIRECTIONALITY

BACKGROUND OF THE INVENTION

The present invention relates generally to a chip carrier having a taught and planar nozzle plate with a nozzle having a true bore formed therein. More specifically, the present invention relates to a chip carrier having a taught and planar nozzle plate with a nozzle that has a nozzle camber angle that is aligned with a firing axis of a thermal ink jet resistor and a nozzle axis of the nozzle so that fluid injected into the nozzle exits in a direction along the nozzle axis.

Articles and publications set forth herein are presented for the information contained therein: none of the information is admitted to be statutory "prior art" and we reserve the right to establish prior inventorship with respect to any such information.

Ink jet drop directionality can be improved by providing a nozzle plate having a nozzle with a true bore. A true bore is simply a nozzle in the nozzle plate that has sidewall surfaces that are uniform and symmetric about an axis of the nozzle. By way of analogy, an example of a true bore is the barrel of a cannon. The cannon has barrel sidewalls that are symmetric with respect to a bore axis of the canon. Thus, a projectile propelled thru the barrel exits the barrel with a trajectory that is along the bore axis. On the other hand, if the barrel has sidewalls that are not symmetric with respect to the bore axis then the barrel will not have a true bore (i.e. a crooked barrel) and the projectile will exit the barrel with a trajectory that is not along the bore axis. Consequently, the projectile will not strike its desired impact point. Therefore, lack of a true bore results in inaccuracies in the trajectory of the projectile.

Similarly, for a thermal ink jet printhead, an ink drop ejected from a firing chamber of the printhead and into a nozzle that does not have a true bore results in the ink drop exiting the nozzle with a trajectory that is not along the nozzle axis. As a result, the ink drop trajectory will deviate from a desired impact point on a print media such as a sheet of paper positioned opposite the nozzle.

In a typical thermal ink jet printhead, a semiconductor substrate is bonded to an orifice plate (a nozzle plate) using a barrier layer. A firing chamber is formed by the substrate and the barrier layer. A firing element such as a thermal ink jet resistor is disposed in the firing chamber and a firing axis of the firing element is aligned with a nozzle axis of a nozzle formed in the nozzle plate. The barrier layer seals the firing chamber to the nozzle plate so that the firing chamber is in fluid communication with the nozzle. A fluid channel communicates ink from an ink reservoir to the firing chamber. The substrate includes a signal line that electrically communicates a signal from a control unit (which may be connected to a source of printing data) to the firing element. A signal communicated to the firing element causes ink disposed on the element to be heated and subsequently ejected from the firing chamber and into the nozzle. The ink drop exits the nozzle with a trajectory that is determined by the symmetry of the nozzle. If the nozzle has a true bore, then the trajectory of the ink drop is substantially along an axis of the nozzle. Conversely, if the nozzle does not have a true bore then the trajectory of the ink drop deviates from the nozzle axis. By way of example, a general discussion of thermal ink jet printheads, nozzle plates, and thermal ink jet printhead construction can be found in the Hewlett-Packard Journal, Volume 39, No. 5, October 1998, Volume 39, No. 4, August 1998, and Volume 36, No. 5, May 1985.

Prior attempts to create a nozzle plate with a true bore nozzle have been frustrated by deformities in the nozzle plate. Typically, the nozzle plate is a thin film of flexible material such as a polyimide film, for example. The nozzle plate has opposed input and output surfaces thru which an orifice (a nozzle) is formed. The nozzle plate is then bonded to the substrate in a process called staking where the barrier layer is applied to the substrate and then heat and pressure are applied to attach the input surface of the nozzle plate to the barrier layer. The completed assembly is then baked at a high temperature to cure the barrier layer.

The deformities in the nozzle plate aries due to compressive buckling of the nozzle plate caused by the staking and baking process. Resulting is dimpling of the nozzle plate. The dimples in the nozzle plate resemble the peaks and troughs of ocean waves and can be sinusoidal in appearance. Therefore, the input and output surfaces of the nozzle plate deviate from planarity such that a nozzle formed in the nozzle plate will not have sidewall surfaces that are symmetric about the nozzle axis.

Moreover, the nozzle has openings on the input and output surfaces. A center point of symmetry on an input side of the nozzle is not coaxially aligned with a center point of symmetry on an output side of the nozzle. Resulting is misalignment between the input and output sides of the nozzle with respect to the nozzle axis. Because of the misalignment, sidewall surfaces of the nozzle are not symmetric with the nozzle axis, therefore, the nozzle does not have a true bore.

Referring to FIG. 1, there is illustrated a dimpled nozzle plate 101 having an input surface 103 disposed opposite an output surface 105. The opposed surfaces have a generally sinusoidal contour; however, the nozzle plate can have other surface deformations that can result in a nozzle that does not have a true bore. A nozzle 107 is formed in the nozzle plate 101 by sidewall surfaces 109 that extend between the input surface 103 and the output surface 105. Those skilled in the ink jet printer art commonly refer to the nozzle plate 101 as an orifice plate and the nozzle 107 as an orifice; however the term nozzle plate and nozzle will be used hereinafter.

A center point of symmetry 111 on an input side 113 (the side from which ink or some other fluid is injected into the nozzle) of the nozzle 107 is not coaxially aligned with a center point of symmetry 115 on an output side 117 of the nozzle 107. A nozzle axis 119 is referenced to the center point of symmetry 111 on the input side 113. Deviation from coaxial alignment between the center points of symmetry is measured in angular degrees by a nozzle camber angle (NCA) 123. The NCA 123 is measured between the nozzle axis 119 and a camber line 121 extending thru the center points of symmetry 111 and 115 respectively. An ink drop or other fluid (not shown) entering the input side 113 of the nozzle 107 will exit the output side 117 with a trajectory that substantially matches the NCA 123 (i.e. the fluid trajectory is along the camber line 121). Because of the dimple in the nozzle plate 101, the sidewall surfaces 109 are not symmetric with respect to the nozzle axis 119 as will be discussed below.

Consequently, the ink drop, for example, will not strike a desired impact point on a print media. FIG. 2 is an illustration of the effect the dimpled nozzle plate 101 of FIG. 1 has on ink drop directionality. A print surface 133 of a print media 131 is shown with a desired impact point X and an actual impact point X' displaced a lateral distance from the desired impact point X. The print media 131 can be a sheet of paper, for example. As can be seen in FIG. 2 the actual impact point X' coincides with the camber line 121 and is caused by the ink drop (not shown) having a trajectory that substantially matches the NCA 123.

Additionally, the sidewall surfaces 109 of the nozzle 107 are not symmetric about the nozzle axis 119 due to the dimpling of the nozzle plate. Lack of symmetry between the nozzle axis 119 and the sidewall surfaces 109 is shown by unequal length radius lines d1 and d1', d2 and d2', and d3 and d3' that extend between the nozzle axis 119 and the sidewall surfaces 109. Essentially, the nozzle 107 does not have a true bore due to lack of symmetry between the sidewall surfaces 109 and the nozzle axis 119.

Accordingly, the center point of symmetry 115 on the output side 117 is not coaxially aligned with the nozzle axis 119 as shown in FIG. 2*a*. The center point of symmetry 115 on the output side 117 is illustrated as a cross "+" and the nozzle axis 119 is illustrated as a dot "•" in FIG. 2*a*.

Ideally, however, it is desirable to have the center point of symmetry 115 on the output side 117 to be coaxially aligned with the nozzle axis 119 as shown in FIGS. 3 and 3*a*. As can be seen in FIG. 3, the center point of symmetry 115 on the output side 117 is coaxially aligned with the center point of symmetry 111 on the input side 113 so that the camber line 121 is coaxially aligned with the nozzle axis 119 and the NCA 123 is substantially 0.0 degrees. Resulting is an ink drop (not shown) that strikes the print side 133 of the print media 131 at the desired impact point X. Essentially the true bore of the nozzle 107 results in the camber line 121 coinciding with the desired impact point X.

Moreover, the sidewall surfaces 109 of the nozzle 107 are symmetrically disposed about the nozzle axis 119 such that the radius lines d1 and d1', d2 and d2', and d3 and d3' are of equal length. Therefore, as can be seen in FIG. 3*a*, the center point of symmetry 115 on the output side 117 is coaxially aligned with the nozzle axis 119. Another way of viewing FIGS. 3 and 3*a* is that coaxial alignment of the center point of symmetry 115 on the output side 117 with the center point of symmetry 113 on the input side 113 results in coaxial alignment of the NCA 123 with the nozzle axis 119, whereby the nozzle 107 has a true bore.

FIG. 4 is an illustration of the dimpled nozzle plate 101 coupled to a substrate 300 that defines an ink jet print head 301 mounted to the input side 103 of the nozzle plate 101 by a barrier layer 303. A firing chamber 305 is formed in the barrier layer 303 and the substrate 300. The barrier layer 303 seals the firing chamber 305 to the nozzle plate 101 so that the firing chamber 305 is in fluid communication with the nozzle 107. A fluid channel 307 supplies ink (not shown) to the firing chamber 305 from an ink reservoir (not shown). The firing chamber 305 includes a firing element 309 disposed in the firing chamber 305 and having a firing axis 311 that is aligned with the nozzle axis 119. A signal line 315 connects the firing element 309 to a control unit (not shown) that electrically communicates a signal to the firing element 309. Those skilled in the ink jet printer art commonly refer to the firing element 309 as a thermal ink jet resistor; however, the term firing element will be used hereinafter.

As mentioned previously, the firing element 309 is operative to heat ink supplied to the firing chamber 305 into an ink bubble 313 that is ejected from the firing chamber 305 along the firing axis 311. The ink bubble 313 enters the input side 113 of the nozzle 107 and exits the nozzle 107 thru the output side 117. As can be seen in FIG. 4, due to dimpling of the nozzle plate 101 the NCA 123 is not aligned with the nozzle axis 119, therefore, the ink drop 213 will have a trajectory that substantially matches the NCA 123. Resulting is inaccuracy in the directionality of the ink drop 313 such that the ink drop 313 travels along the camber line 121 rather than the nozzle axis 119.

Although FIG. 4 shows dimple on the output surface 105, the input surface 103 may also be dimpled. Dimpling of the input surface 103 can cause additional problems, namely, a defective fluid seal between printhead 301 and the nozzle plate 101 caused by voids in the barrier layer 303. The ink drop 313 can be diverted into those voids resulting in reduced ink drop output, a clogged nozzle, or a defective firing chamber. Accordingly, it is important that both the input surface 103 and output surface 105 be planar surfaces that are parallel to each other.

Therefore, there is a need to overcome the disadvantages associated with dimpling of the nozzle plate and the resulting inaccuracies in ink drop directionality. A nozzle plate that is taught and has planar input and output surfaces can eliminate the dimpling of the nozzle plate. Furthermore, the planar surfaces of the nozzle plate result in the input and output surfaces being parallel to each other. The taught nozzle plate provides a surface thru which a true bore nozzle can be formed and provides a flat and stable surface for mounting the ink jet printhead to the nozzle plate.

Moreover, there is a need for a nozzle plate that remains taught and maintains planarity of the input and output surfaces after the nozzle plate has been subjected to the staking and baking process.

Another disadvantage to mounting the ink jet printhead to the nozzle plate is that the signal lines in the printhead must be connected to a control unit that communicates print signals to the printhead. In a typical application, the nozzle plate includes electrically conductive traces that are disposed on the input or output surfaces. The traces connect to a bonding pad or similar structure on the printhead and are operative to communicate signals from the control unit to the signal lines connected to the firing element. The traces can be patterned on the nozzle plate using PC board lithography techniques, for example. Alternatively, wire bonds can be used to facilitate connection of the control unit to the signal lines. One or more apertures are formed in the nozzle plate to facilitate routing of the trace or the wire bond to the printhead.

Thus, the nozzle plate may need to be made larger in order to accommodate the traces and apertures. It is more difficult to prevent surface irregularities in a nozzle plate that serves dual roles as both a fluidic device and an electronic device, mainly due to the larger area of the nozzle plate and defects introduced by processing steps related to making the necessary electrical connections to the printhead.

Therefore, there is a need to overcome the disadvantages associated with combining the fluidic and electronic functions in the nozzle plate. A carrier frame operative to support the nozzle plate so that the printhead can be mounted to the nozzle plate without electrical connections can decouple the fluidic and electronic functions of the nozzle plate. A separate flexible circuit material can be connected to the carrier frame and can communicate electrical signals between the control unit and the printhead. Separation of the electronic and fluidic functions has the added advantage of allowing the nozzle plate and the flex circuit to be made from different materials.

SUMMARY OF THE INVENTION

The problems and limitations associated with dimpling of the nozzle plate are addressed by various aspects of the present invention. Dimpling of the nozzle plate is eliminated by disposing the nozzle plate on a carrier frame and staking and baking the nozzle plate to the carrier frame so that the nozzle plate is taught, planar, and has input and output surfaces that are parallel to each other. After the staking and baking process the nozzle plate remains taught and planar so that nozzles formed in the nozzle plate have a true bore. The carrier frame and the nozzle plate define a chip carrier. An ink jet printhead is mounted to an input surface of the nozzle plate.

Additionally, the problems associated with a nozzle plate that performs both fluidic and electronic functions is solved by using the above mentioned chip carrier and including an electrically conductive bonding pad on the carrier frame. A separate flex circuit that carries electrically conductive traces is mounted to the carrier frame and the traces are connected to the bonding pads on the carrier frame. Signal lines on an ink jet printhead mounted to the nozzle plate can be connected to the bonding pads thereby decoupling the fluidic function of the nozzle plate from the electronic function of the traces. The flex circuit and the nozzle plate need not be made from the same material. For instance, the nozzle plate can be made from a material capable of forming a taught nozzle plate and the flex circuit can be made from a material that is well suited for patterning and etching of signal lines.

Broadly, the present invention provides a chip carrier that includes a carrier frame having opposed shelf and base surfaces, a frame aperture extending between the shelf and base surfaces, and a nozzle plate having opposed input and output surfaces. A nozzle is formed by sidewall surfaces that extend between the opposed surfaces. The nozzle plate is fixedly disposed on the shelf surface of the carrier frame with the input surface adjacent to the frame aperture. The nozzle plate is characterized by being disposed on the shelf surface in a state of tensile stress so that the input and output surfaces are taught, planar, and parallel to each other.

The tensile stress on the nozzle plate is operative to symmetrically dispose the sidewall surfaces of the nozzle with respect to a nozzle axis so that the nozzle has a true bore and a nozzle camber angle is coaxially aligned with a nozzle axis. A fluid injected into the nozzle exits the nozzle with a trajectory that substantially matches the nozzle camber angle.

In one embodiment of the present invention, the nozzle plate is made from a first material that has a first thermal expansion coefficient and the carrier frame is made from a second material that has a second thermal expansion coefficient. The second thermal expansion coefficient is less than the first thermal expansion coefficient so that the dissimilarity between the first and second thermal expansion coefficients operates to generate the tensile stress on the nozzle plate.

In another embodiment of the present invention, the nozzle has converging sidewall surfaces that converge in a direction toward an output side of the nozzle. In one embodiment the converging sidewall surfaces are arcuate in shape.

In one embodiment of the present invention, the nozzle plate is fixedly .connected to the shelf surface of the carrier frame by an adhesive disposed between the shelf surface and the input surface of the nozzle plate.

In another embodiment of the present invention, the shelf surface includes a raised portion defining a lip that extends outward of the shelf surface and terminates in a planar upper surface. The input surface of the nozzle plate is disposed on the upper surface of the lip and the nozzle plate is fixedly connected to the shelf surface by an adhesive disposed between the shelf surface and the input surface of the nozzle plate. The lip provides a flat reference plane upon which to mount the nozzle plate so that planarity of the nozzle plate is not compromised by non-uniform thickness of the adhesive.

In one embodiment of the present invention, a barrier layer mounts an ink jet printhead to the input surface of the nozzle plate. A firing chamber of the printhead is aligned with and is in fluid communication with a nozzle in the nozzle plate. The firing chamber includes a firing element that has a firing axis that is coaxially aligned with the nozzle axis.

In another embodiment of the present invention, the nozzle plate includes at least one feed-thru aperture for routing an interconnect line from a bonding pad disposed on the carrier frame to a signal line on the ink jet printhead.

In one embodiment of the present invention, the chip carrier is mounted to a flex circuit that includes an electrically conductive trace. The trace connects to a bonding pad disposed on the carrier frame. The bond pad is in electrical communication with the signal line in the ink jet printhead. The trace is operative to communicate a signal from the control unit to the signal line.

Other aspects and advantages of the present invention will become apparent from the following detailed description, taken in conjunction with the accompanying drawings, illustrating by way of example the principles of the present invention.

BRIEF DESCRIPTION OF THE DRAWINGS

FIG. 3*a* top view of the nozzle of FIG. 3 and illustrates alignment of the center points of symmetry on the input and output sides of the nozzle according to the present invention.

DETAILED DESCRIPTION

Figure 1:
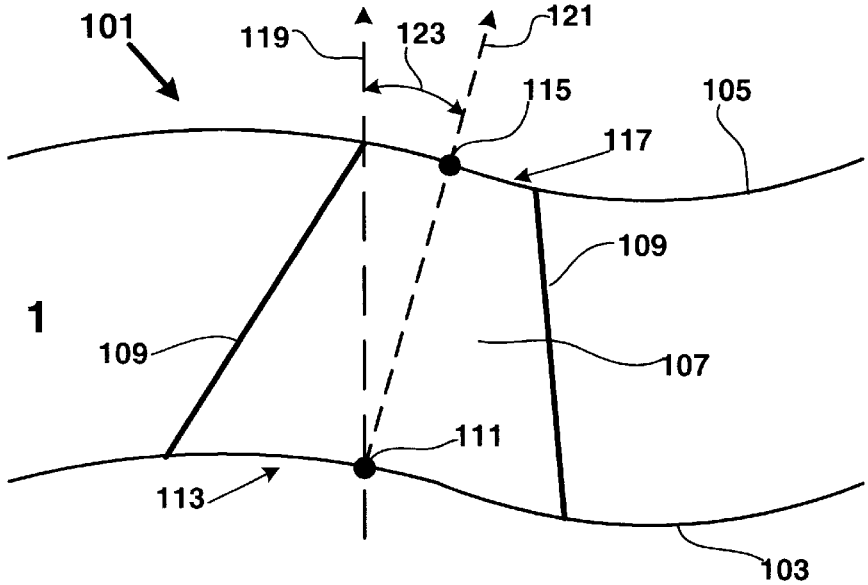
FIG. 1 is a cross-sectional view of a dimpled nozzle plate and a nozzle that does not have a true bore.
Figure 2:
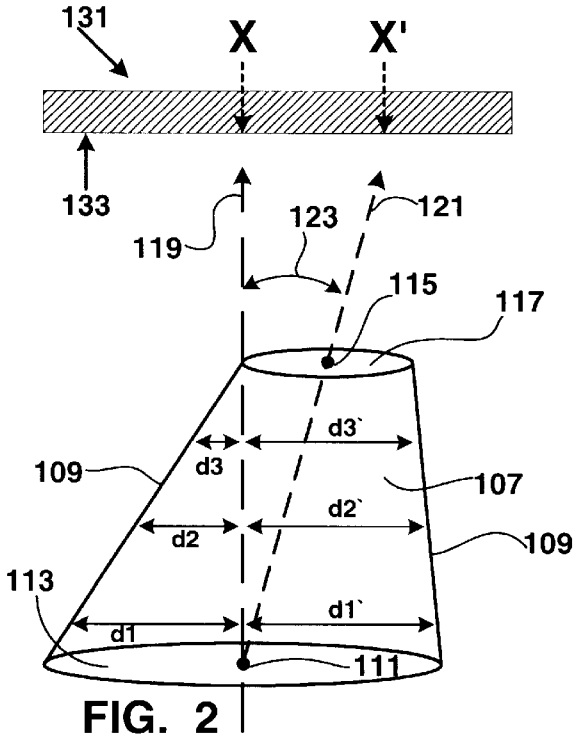
FIG. 2 is a cross-sectional view illustrating the effect the dimpled nozzle plate of FIG. 1 has on ink drop directionality and on symmetry of the nozzle sidewall surfaces with respects to the nozzle axis.
Figure 3:
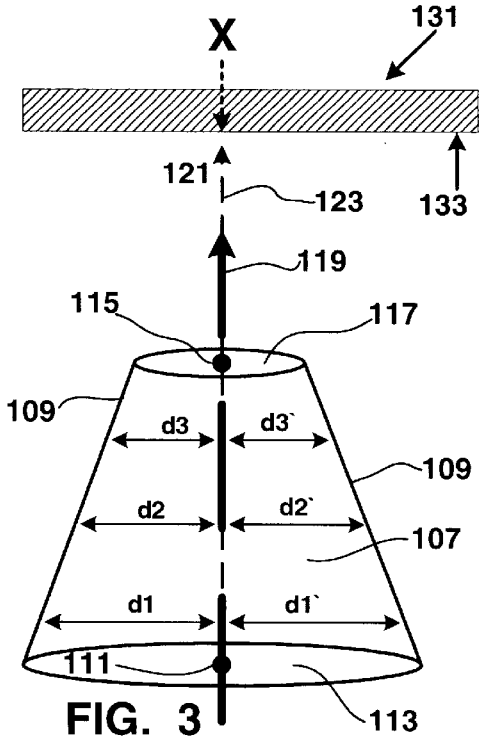
FIG. 3 is a cross-sectional view illustrating a nozzle having a true bore and sidewall surfaces that are symmetric about the nozzle axis according to the present invention.
Figure 2A:
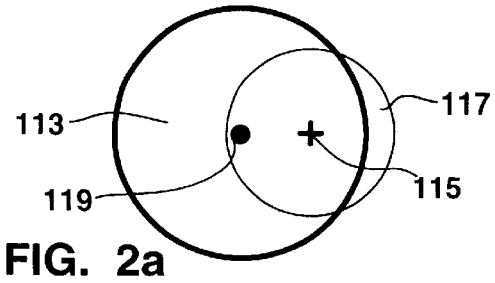
FIG. 2*a* is a top view of the nozzle of FIG. 2 and illustrates misalignment between the input and output sides of the nozzle caused by the dimpled nozzle plate of FIG. 1.
Figure 3A:
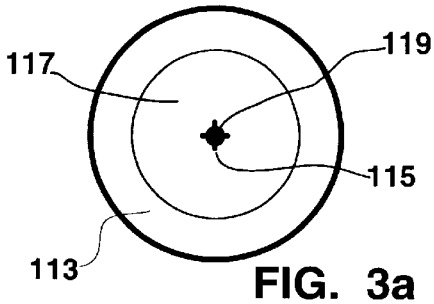
Figure 4:
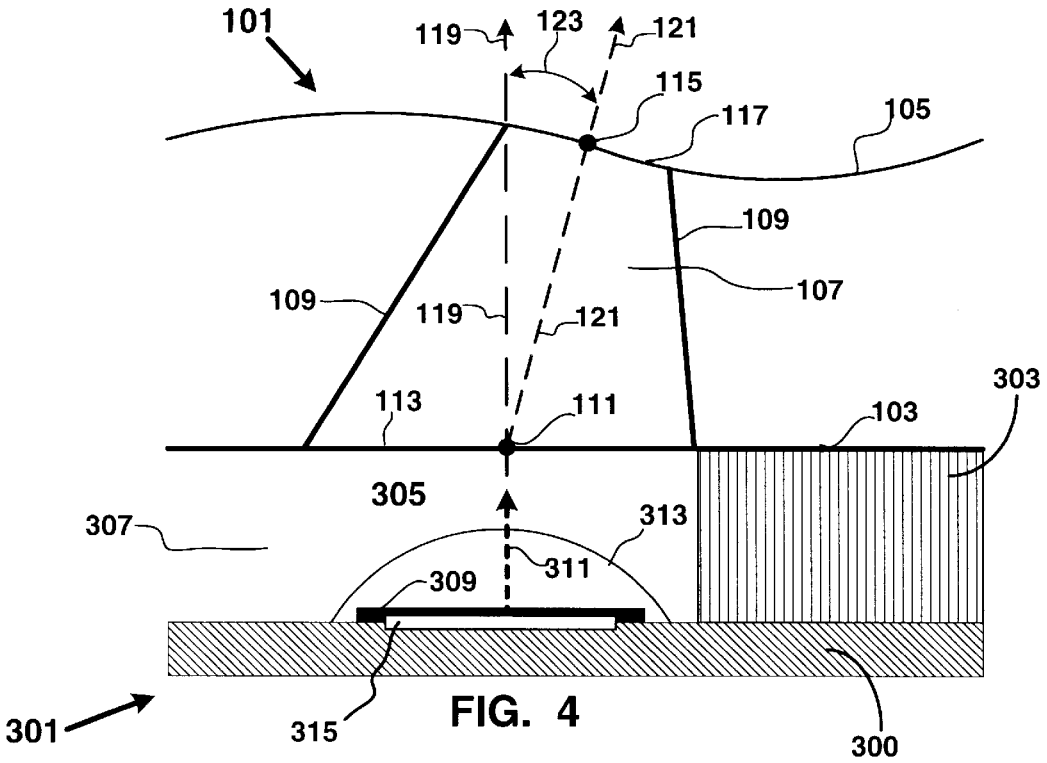
FIG. 4 is a cross-sectional view of an ink jet printhead mounted to the input surface of a dimpled nozzle plate.

In the following detailed description and in the several figures of the drawings, like elements are identified with like reference numerals.

As shown in the drawings for purpose of illustration, the present invention is embodied in an a chip carrier that includes a carrier frame having opposed shelf and base surfaces and a frame aperture that extends between the shelf and base surfaces. A nozzle plate having opposed input and output surfaces is disposed on the shelf surface with the input surface positioned adjacent to the frame aperture. The nozzle plate is fixedly connected to at least two opposing sides of the shelf surface.

The nozzle plate is disposed on the shelf surface in a state of tensile stress so that the input and output surfaces of the nozzle plate are taught, planar, and parallel to each other. The tensile stress on the nozzle plate eliminates dimpling of the input and output surfaces. A nozzle is formed by sidewall surfaces that extend between the input and output surfaces. The nozzle has a nozzle camber angle that is measured relative to a nozzle axis. The nozzle camber angle is defined by an angular displacement between a center point of symmetry on an input side of the nozzle and a center point of symmetry on an output side of the nozzle.

The shelf surface of the carrier frame can include a raised portion defining a lip that extends outward of the shelf surface and terminates in a planar upper surface. The input surface of the nozzle plate can be disposed on the planar upper surface. The upper surface of the lip provides a flat reference plane for the nozzle plate whereby non-uniform thickness of an adhesive used to fixedly attach the input surface of the nozzle plate to the shelf surface does not compromise the planarity of the nozzle plate. As a result, nozzles formed in the nozzle plate maintain a true bore and drop directionality is improved.

The tensile stress on the nozzle plate is operative to symmetrically dispose the sidewall surfaces of the nozzle about the nozzle axis and to align the center points of symmetry of the input and output sides of the nozzle with the nozzle axis so that the nozzle camber angle is coaxially aligned with the nozzle axis and the nozzle camber angle is substantially 0.0 degrees.

In essence, the taught nozzle plate provides a planar surface through which a nozzle having a true bore can be formed. Thus, a fluid injected into the nozzle thru the input side of the nozzle will exit the output side of the nozzle with a fluid trajectory that substantially matches the nozzle camber angle.

Accordingly, the problems associated with dimpling of the nozzle plate are solved by the chip carrier of the present invention. The carrier frame provides a stable platform upon which the nozzle plate can be mounted. The tensile stress acting on the nozzle plate results in a planar and taught nozzle plate that remains taught and planar after the previously mentioned stake and bake process. A nozzle formed in the nozzle plate has sidewall surfaces that are symmetric about the nozzle axis thereby creating a true bore nozzle that improves the drop directionality of a fluid exiting the nozzle such as an ink drop, for example. Because the ink drop has a trajectory that is along the nozzle axis, the ink drop will impact a print surface positioned opposite the nozzle with greater directional accuracy when compared to the ink drop directionality of a dimpled nozzle plate.

A flex circuit having opposed front and back surfaces and a nozzle aperture extending between the opposed surfaces can be used to mount the chip carrier of the present invention with the nozzle plate positioned in the nozzle aperture. A bonding pad disposed on the carrier frame and an electrically conductive trace disposed on the back surface can be used to decouple the fluidic function of the nozzle plate from the electronic function of communicating electrical signals to an ink jet printhead disposed on the input surface of the nozzle plate.

Additionally, by decoupling the electronic and fluidic functions, the chip carrier of the present invention can eliminate electronic traces that would normally be disposed on the output surface of the nozzle plate. Consequently, the output side of the nozzle plate can be positioned closer to a print media such as a piece of paper, for example. Ink drop directionality is further improved by reducing the distance between the nozzle plate and the print media because the ejected ink drop travels a shorter distance from the nozzle to the surface to be printed. Furthermore, by decoupling the electronic and fluidic functions, the nozzle plate and the flex circuit can be made from different materials as will be discussed below.

Figure 6:
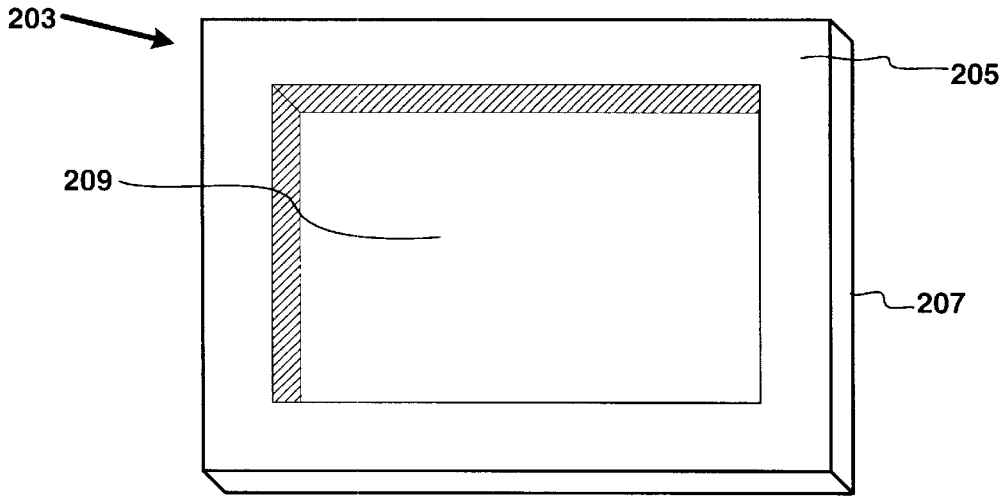
FIG. 6 is a top plan view of a carrier frame according to the present invention.
Figure 7:
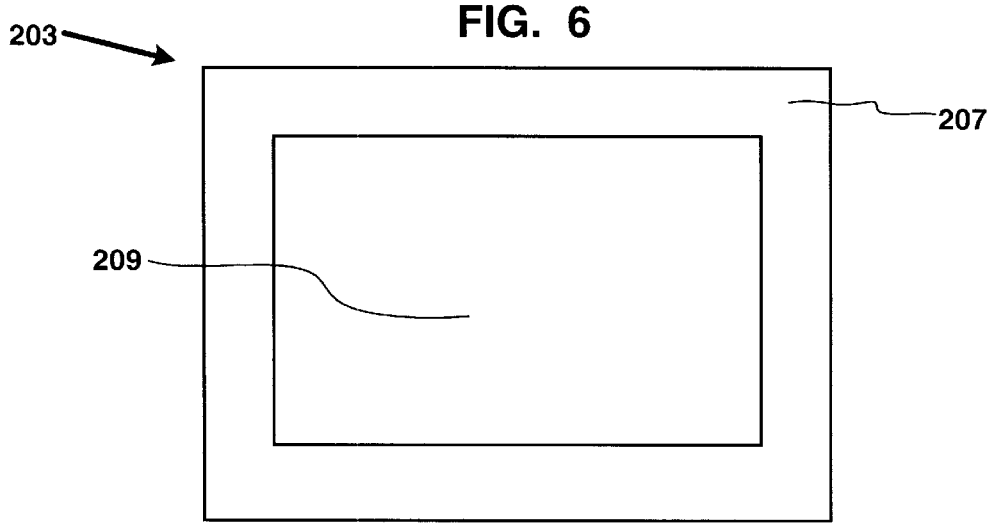
FIG. 7 is a bottom plan view of a base surface of the carrier frame of FIG. 6 according to the present invention.
Figure 8:
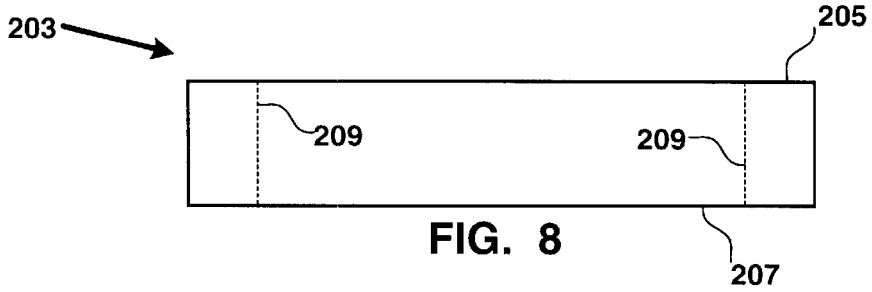
FIG. 8 is a cross-sectional view of the carrier frame of FIG. 6 according to the present invention.

Referring to FIGS. 6, 7, and 8, the chip carrier of the present invention includes a carrier frame 203 having opposed shelf 205 and base 207 surfaces. The carrier frame 203 has a frame aperture 209 that extends between the opposed surfaces. FIG. 7 is a bottom plan view of the carrier frame 203 showing the base surface 207. FIG. 8 is a cross sectional view of the carrier frame 203 showing the frame aperture 209 (shown in dashed lines) extending between the shelf surface 205 and the base surface 207. Although the carrier frame 203 is illustrated as being rectangular in shape, the shape of the carrier frame is not limited to the rectangular shape thus illustrated.

Figure 9:
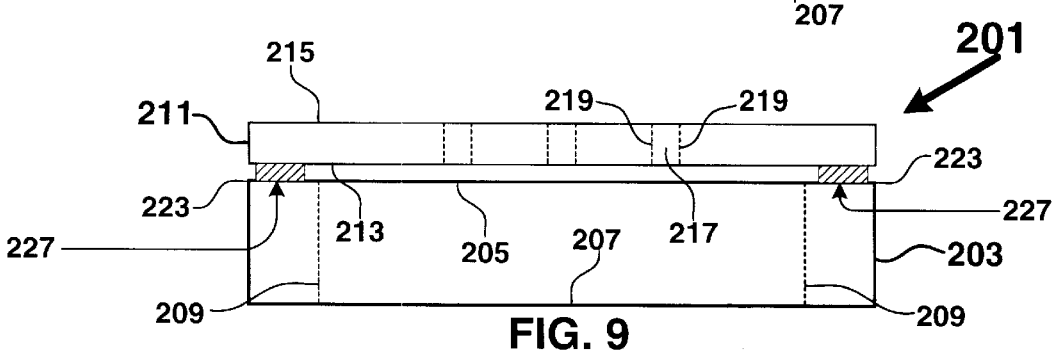
FIG. 9 is a cross-sectional view of the carrier frame of FIG. 6 having a taught nozzle plate disposed on a shelf surface of the carrier frame according to the present invention.

Referring to FIG. 9, a chip carrier 201 of the present invention includes the carrier frame 203 as discussed above and a nozzle plate 211. The nozzle plate 211 includes opposed input 213 and output 215 surfaces. At least one nozzle 217 is formed in the nozzle plate by sidewall surfaces 219 that extend between the input surface 213 and the output surface 215. Although the nozzle plate 211 is shown having three nozzles, the nozzle plate 211 can have only one nozzle or a plurality of nozzles. Typically, a nozzle plate for an ink jet printhead (not shown) will have a plurality of nozzles arranged in an array pattern on the nozzle plate.

The nozzle plate 211 is disposed on the shelf surface 205 of the carrier frame 203 with the input surface 213 positioned adjacent to the frame aperture 209. The nozzle plate 211 is fixedly connected to at least one pair of opposing sides 223 of the shelf surface 205. The nozzle plate 211 can be fixedly connected to the shelf surface of the nozzle plate using an adhesive 227, for example. The adhesive 227 is disposed between the shelf surface 205 and the input side 213.

Figure 10:
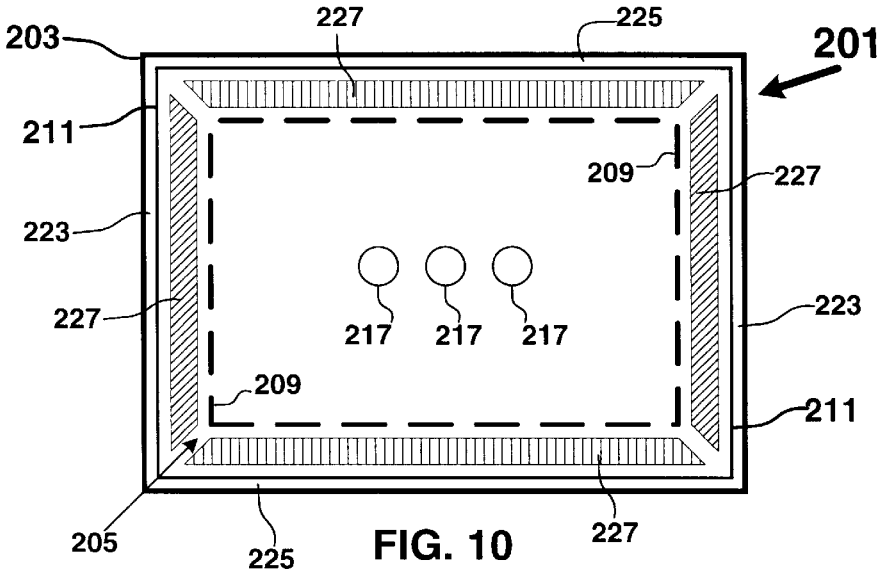
FIG. 10 is a top plan view of the carrier frame of FIG. 6 having a taught nozzle plate fixedly connected to opposing sides of the shelf surface.

Referring to FIG. 10, the adhesive 227 can be applied to at least one pair of opposing sides of the shelf surface 205 of the carrier frame 203. Therefore, one pair of opposing sides 223 can have the adhesive 227 disposed thereon. Alternatively, another pair of opposing sides 225 can have the adhesive 227 disposed thereon. On the other hand, the adhesive 227 can be disposed on both pairs of opposing sides 223 and 226 respectively so that the input surface 213 of the nozzle plate is fixedly connected to all four sides of the shelf surface 205. The input side 213 of the nozzle plate 211 is positioned adjacent to the frame aperture 209 with the nozzle 217 disposed over the frame aperture 209. A fluidic device such as an ink jet printhead (not shown), for example, can then be positioned in the frame aperture 209 and mounted to the input side 213 with a firing chamber of the device aligned with the nozzle 217.

The nozzle plate 211 is permanently connected to the shelf surface of the carrier frame 203 by applying the adhesive 227 in a liquid state, then cross linking the adhesive 227 to form a solid. Next, heat and pressure are applied to the nozzle plate 211 and the carrier frame 203, thereby staking the nozzle plate 211 to the carrier frame 203. Following the staking step, the adhesive 227 is cured by baking the chip carrier 201 at a high temperature to dry out any moisture in the nozzle plate 211 and to shrink the nozzle plate 211. The shrinking results in a taught nozzle plate 211 that is planar (flat surface) and has parallel input 213 and output 215 surfaces. However, the carrier frame 203 does not shrink as much as the nozzle plate 211. Consequently, the nozzle plate 211 is disposed on the shelf surface 205 in a state of tensile stress.

Adhesives such as RISTON™, VACREL™, and PARAD™, for example, can be used to fixedly attach the nozzle plate 211 to the shelf surface 205.

The tensile stress results in the input 213 and output 215 surfaces of the nozzle plate 211 being taught (like the head of a drum). Moreover, the tensile stress acting on the nozzle plate 211 is operative to make the input 213 and output 215 surfaces planar and parallel to each other. Therefore, the aforementioned problems associated with dimpling of the nozzle plate are addressed by the chip carrier 201 of the present invention.

Figure 11:
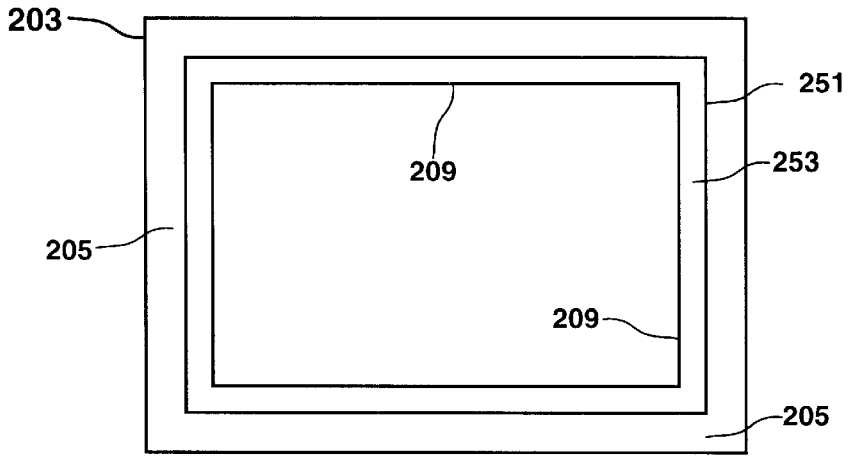
FIG. 11 is a top plan view of a carrier frame having a lip disposed on the shelf surface thereof according to the present invention.
Figure 12:
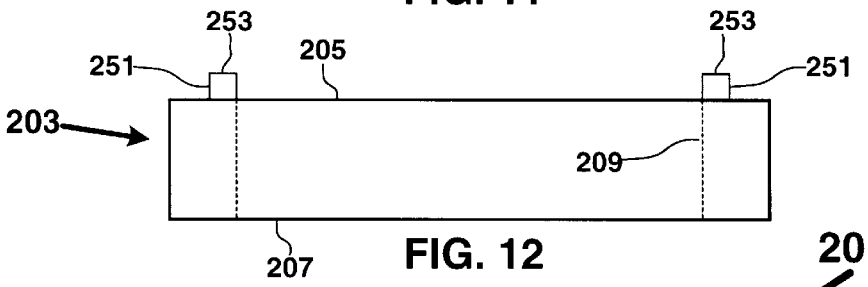
FIG. 12 is a cross-sectional view of the carrier frame and the lip of FIG. 11 according to the present invention.
Figure 13:
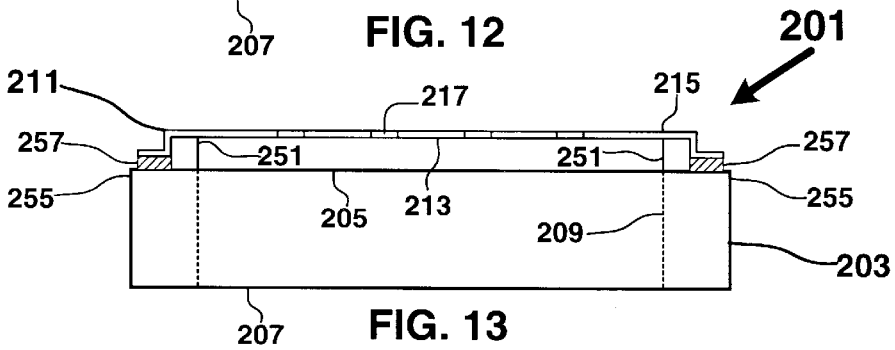
FIG. 13 is a cross-sectional view of the carrier frame of FIG. 12 having a taught nozzle plate disposed on a planar upper surface of the lip and fixedly connected to the shelf surface according to the present invention.

In one embodiment of the present invention as illustrated in FIGS. 11, 12, and 13, the shelf surface 205 of the carrier frame 203 includes a raised portion defining a lip 251. The lip 251 extends outward of the shelf surface 205 and terminates in an planar upper surface 253. Referring to FIG. 13, the input surface 213 of the nozzle plate 211 is disposed on the planar upper surface 253 of the lip 251 and the nozzle plate 211 is fixedly connected to the shelf surface 205 by an adhesive 257.

The lip 251 provides a flat reference plane (the planar upper surface 253) for mounting the nozzle plate 211. By placing the reference plane for the nozzle plate 211 above the shelf surface 205, non-uniform thickness of the adhesive 257 will not compromise the planarity of the nozzle plate 211 or its opposed surfaces.

For instance, in FIG. 10, if the input side 213 of the nozzle plate 211 is fixedly connected to the shelf surface 205 at the first pair of opposing sides 223 and the side on the left has a thicker layer of the adhesive 227, then the nozzle plate 211 will have a slight tilt (slope) towards the side right side because the layer of adhesive 227 is thinner on the right side. A sloped nozzle plate defeats the goal of having a planar nozzle plate 211.

Accordingly, the lip 251 of FIG. 12 isolates that portion of the nozzle plate 211 that must be planar from the portion that is fixedly connected to the shelf surface 205. Although FIG. 11 illustrates the lip 251 encircling the frame aperture 209, the lip 251 can be disposed on at least one pair of opposing sides of the shelf surface 205. The staking and baking process described above can be used to fixedly connect the nozzle plate 211 to the carrier frame and to generate the tensile stress on the nozzle plate 211.

In another embodiment of the present invention, the nozzle plate 211 is made from a first material having a first thermal expansion coefficient and the carrier frame 203 is made from a second material having a second thermal expansion coefficient. The second thermal expansion coefficient of the carrier frame 203 is less than the first thermal expansion coefficient of the nozzle plate 211. The dissimilarity between the first and second thermal expansion coefficients is operative to generate the tensile stress on the nozzle plate 211. As a result of the staking and baking process, as the chip carrier 201 cools off, the nozzle plate 211 shrinks at a higher rate than the carrier frame 203 due the carrier frame 203 be made from a material having a thermal expansion coefficient that is less than that of the nozzle plate 211. Once the carrier frame 201 has completely cooled off, the nozzle plate 211 is disposed on the carrier frame 203 in tensile stress so that the opposed surfaces of the nozzle plate 211 are taught, planar, and parallel to each other.

In one embodiment of the present invention, the first thermal expansion coefficient for the nozzle plate 211 is in a range from about 12.00 ppm/°C. to about 25.00 ppm°C., and the second thermal expansion coefficient for the carrier frame 203 is in a range from about 3.00 ppm/°C. to about 11.00 ppm°C.

In another embodiment of the present invention, the first material for the nozzle plate 211 can be polyimide film, KAPTON™, UPILEX™, and APICAL™, for example. The second material for the carrier frame 203 can be ceramic, alumina, nickel-iron alloy, KOVAR™, and INVAR™, for example.

The above materials for the nozzle plate 211 can be laser ablated as will be discussed below, have good adhesion properties, and resist penetration by water. The above materials for the carrier frame 203 are known for their low thermal expansion coefficients, are rigid, stable, and resistant to ink corrosion.

The materials for the nozzle plate 211 and the carrier frame 203 should be selected so that dissimilarity between the thermal expansion coefficients of the materials results in tensile stress on the nozzle plate 211. Moreover, for ink jet applications, the. materials for the nozzle plate 211 and the carrier frame 203 should be selected based on their resistence to the corrosive effects of ink. In general, corrosion and chemical attack by fluids used in conjunction with the chip carrier 201 of the present invention should be taken into consideration when selecting appropriate materials for the nozzle plate 211 and the carrier frame 203.

In one embodiment of the present invention, the tensile stress on the nozzle plate 211 is in a range from about 6.50 Mpa to about 140.0 Mpa. The actual tensile stress acting on the nozzle plate 211 can vary with temperature. However, the above range represents the range of tensile stress at about room temperature.

Figure 5:
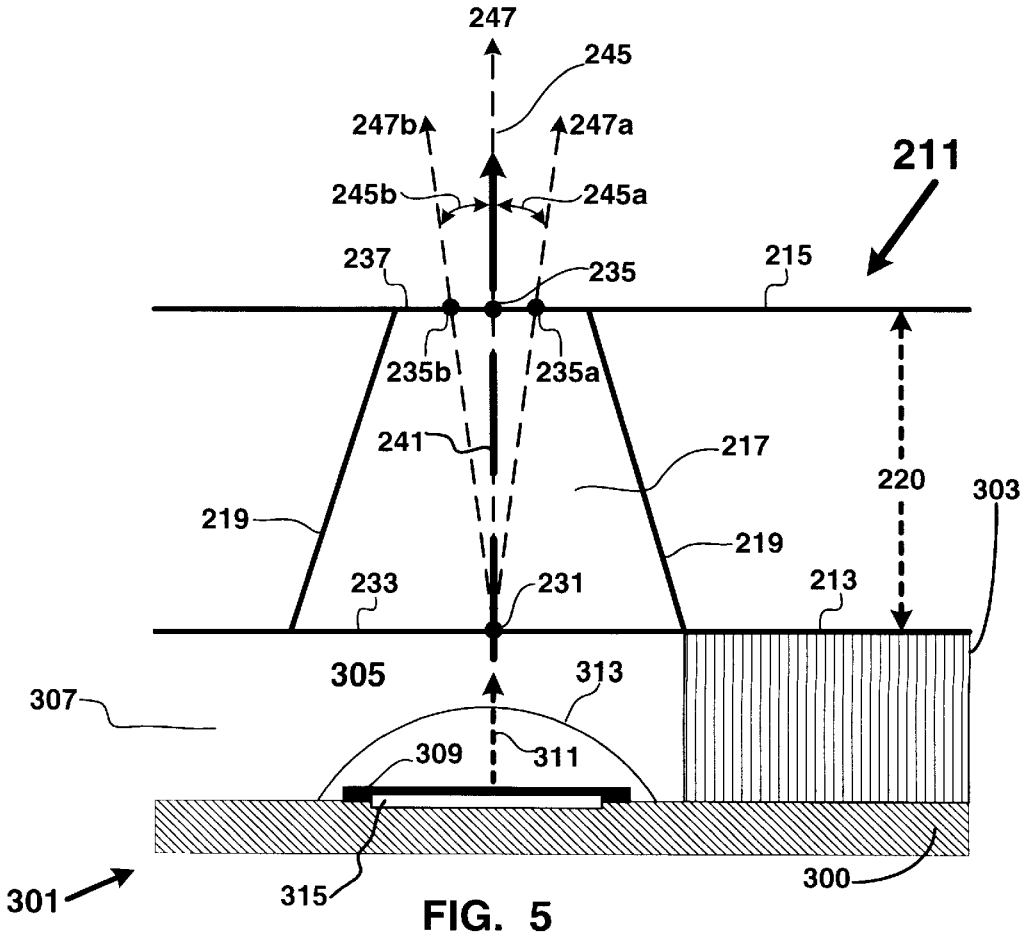
FIG. 5 is a cross-sectional view of an ink jet printhead mounted to the input surface of a taught and planar nozzle plate according to the present invention.

Referring to FIG. 5, the nozzle 217 is illustrated in greater detail. The nozzle 217 includes a center point of symmetry 231 on an input side 233 of the nozzle 217 and a center point of symmetry 235 on an output side 237 of the nozzle 217. A nozzle axis 241 (heavy dashed arrow) is referenced to the center point of symmetry 231 on the input side 233 and extends from the input side 233 thru the output side 237. A nozzle camber angle 245 (NCA) is measured relative to the nozzle axis 241 and is defined by angular displacement between the center point of symmetry 231 on the input side 233 and the center point of symmetry 235 on the output side 237. FIG. 5 illustrates a small portion of the nozzle plate 211 that is positioned adjacent to the frame aperture 209 (not shown). Accordingly, the carrier frame 203 is not shown in FIG. 5.

The tensile stress acting on the nozzle plate 211 is operative to symmetrically dispose the sidewall surfaces 219 about the nozzle axis 241 and to align the center point of symmetry 231 on the input side 233 with the center point of symmetry 235 on the output side 237 so that the NCA 245 is substantially 0.0 degrees and is coaxially aligned with the nozzle axis 241. An alternative way of viewing the relationship between the NCA 245 and the nozzle axis 241 is that when the NCA 245 is 0.0 degrees, a camber line 247 is coaxially aligned with the nozzle axis 241. The camber line extends from the center point of symmetry 231 on the input side 233 thru the center point of symmetry 235 on the output side 237. Consequently, the taught nozzle plate 211 of the present invention has planar input 213 and output 215 surfaces that are parallel to each other as illustrated in FIG. 5.

On the other hand, a dimpled nozzle plate or other deformities in the nozzle plate can result in misalignment between the nozzle axis 241 and the NCA 245 such that the center point of symmetry 235 on the output side 237 is not aligned with the center point of symmetry 231 on the input side 233. Accordingly, the NCA 245 is not 0.0 degrees and the camber line 247 is not coaxially aligned with the nozzle axis 241.

For instance, FIG. 5 illustrates a first angular displacement between the center point of symmetry 231 on the input side 233 and the center point of symmetry 235*a* on the output side 237. A camber line 247*a* results in a non-zero NCA of 245*a*. Similarly, FIG. 5 illustrates a second angular displacement between the center point of symmetry 231 on the input side 233 and the center point of symmetry 235*b* on the output side 237. A camber line 247*b* results in a non-zero NCA of 245*b*. Although FIG. 5 illustrates the angular displacements in two-dimensions, it will be clear to one skilled in the art to which the present invention pertains that camber lines 247*a* and 247*b* and their respective NCA's of 245*a* and 245*b* define a cone half-angle about the nozzle axis 241.

In one embodiment of the present invention, the NCA 247 deviates from coaxial alignment with the nozzle axis 241 by no more than about 1.0 degrees. For example, in FIG. 5, the NCA 245*a* would be out of alignment with the nozzle axis 241 by no more than about 1.0 degree. Similarly, the NCA 245*b* would be out of alignment with the nozzle axis 241 by no more than about 1.0 degrees.

Moreover, the NCA 247 can be effected by a thickness 220 as measured between the input 213 and output 215 surfaces of the nozzle plate 211. If the nozzle plate 211 is too thin the NCA 247 can be coaxially misaligned with the nozzle axis 241 by more than 1.0 degrees. Conversely, the NCA 247 can be coaxially misaligned with the nozzle axis 241 by more than 1.0 degrees if the nozzle plate 211 is too thick.

In another embodiment of the present invention the nozzle plate 211 has a thickness 220 (shown in dashed line) from about 12.70 $\mu$m to about 152.40 $\mu$m, and more preferably from about 25.40 $\mu$m to about 127.00 $\mu$m.

Figure 28:
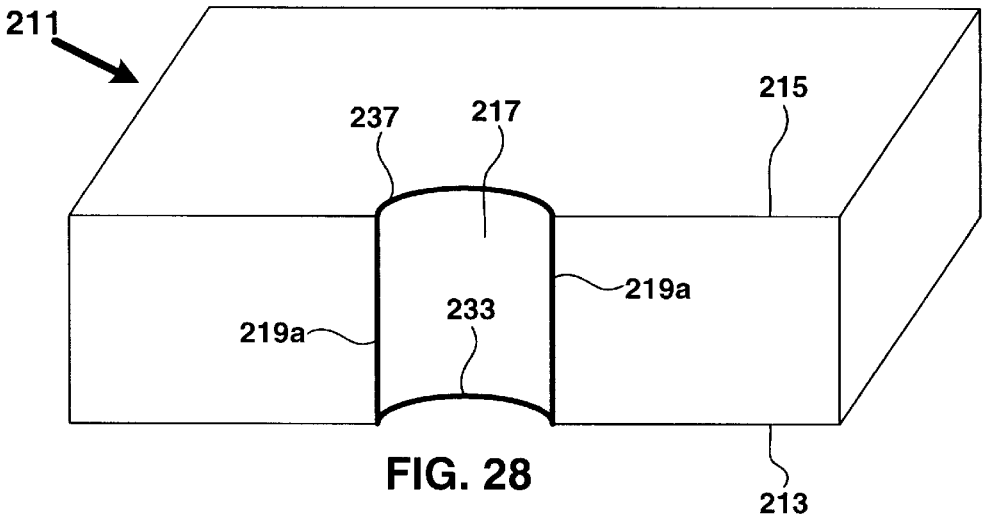
FIG. 28 is a cross-sectional view of a nozzle plate with substantially vertical sidewall surfaces according to the present invention.
Figure 29:
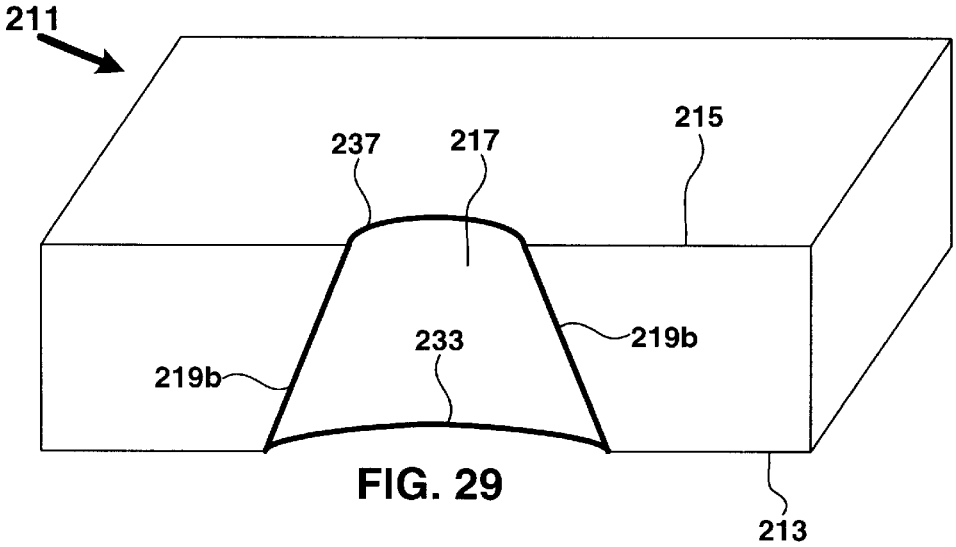
FIG. 29 is a cross-sectional view of a nozzle plate having a nozzle with sidewall surfaces that converge towards the output side of the nozzle according to the present invention.
Figure 30:
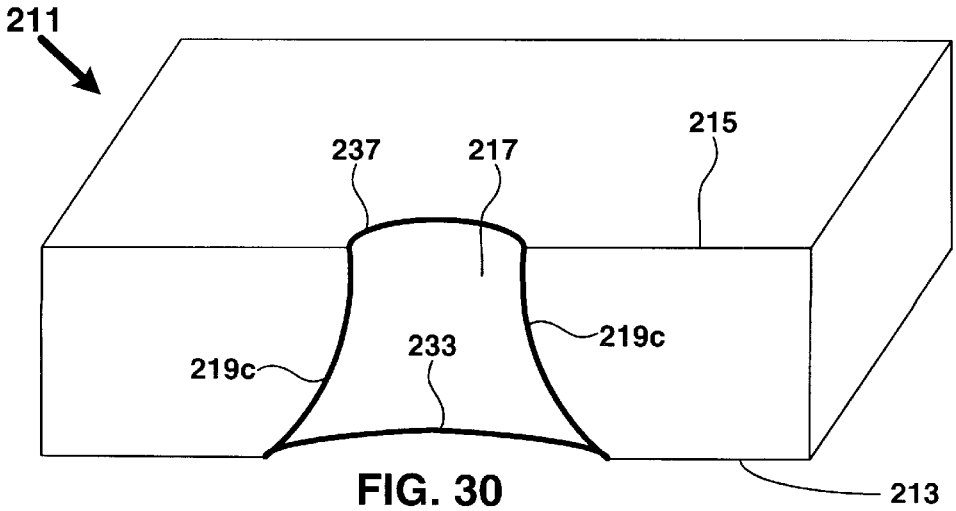
FIG. 30 is a cross-sectional view of a nozzle plate having a nozzle with converging sidewall surfaces that are arcuate in shape according to the present invention.

The nozzle 217 of the present invention can be formed in the nozzle plate 211 by laser ablating the nozzle plate 211 to form a thru hole that extends between the input 213 and output 215 surfaces. Accordingly, the material selected for the nozzle plate 211 should be able to withstand laser ablation. After laser ablation of the nozzle plate, the nozzle 217 can have substantially vertical sidewall surfaces 219*a* as illustrated in FIG. 28. Preferably, the nozzle 217 has converging sidewall surfaces 219*b* that converge in a direction toward the output side 237 of the nozzle 217 as illustrated in FIG. 29. More preferably, the nozzle 217 has converging sidewall surfaces 219*c* that are arcuate in shape and converge in a direction toward the output side 237 of the nozzle 217 as illustrated in FIG. 30.

FIG. 5 also illustrates the taught nozzle plate 211 to coupled to a substrate 300 that defines an ink jet print head 301 mounted to the input side 213 of the nozzle plate 211 by a barrier layer 303. A firing chamber 305 is formed in the barrier layer 303 and the substrate 300. The barrier layer 303 seals the firing chamber 305 to the input side 213 of the nozzle plate 211 so that the firing chamber 305 is in fluid communication with the nozzle 217. A fluid channel 307 supplies ink (not shown) to the firing chamber 305 from an ink reservoir (not shown). The firing chamber 305 includes a firing element 309 disposed in the firing chamber 305 and having a firing axis 311 that is aligned with the nozzle axis 241. A signal line 315 connects the firing element 309 to a control unit (not shown) that electrically communicates a signal to the firing element 309. Those skilled in the ink jet printer art commonly refer to the firing element 309 as a thermal ink jet resistor; however, the term firing element will be used hereinafter. Furthermore, the firing element 309 is not to be construed as being limited to a thermal ink jet resistor. For instance, the firing element 309 can be a piezoelectric transducer.

As mentioned previously, the firing element 309 is operative to convert the ink supplied to the firing chamber 305 into an ink bubble 313 that is ejected from the firing chamber 305 along the firing axis 311. The ink bubble 313 enters the input side 233 of the nozzle 217 and exits the nozzle 217 thru the output side 237. As can be seen in FIG. 5, due to the taught nozzle plate 211 the NCA 245 is aligned with the nozzle axis 241, therefore, the ink drop 313 will have a trajectory that substantially matches the NCA 245. Resulting is improved accuracy in the directionality of the ink drop 313 such that the ink drop 313 travels along the camber line 247 with a trajectory that substantially matches the NCA 245.

Figure 31:
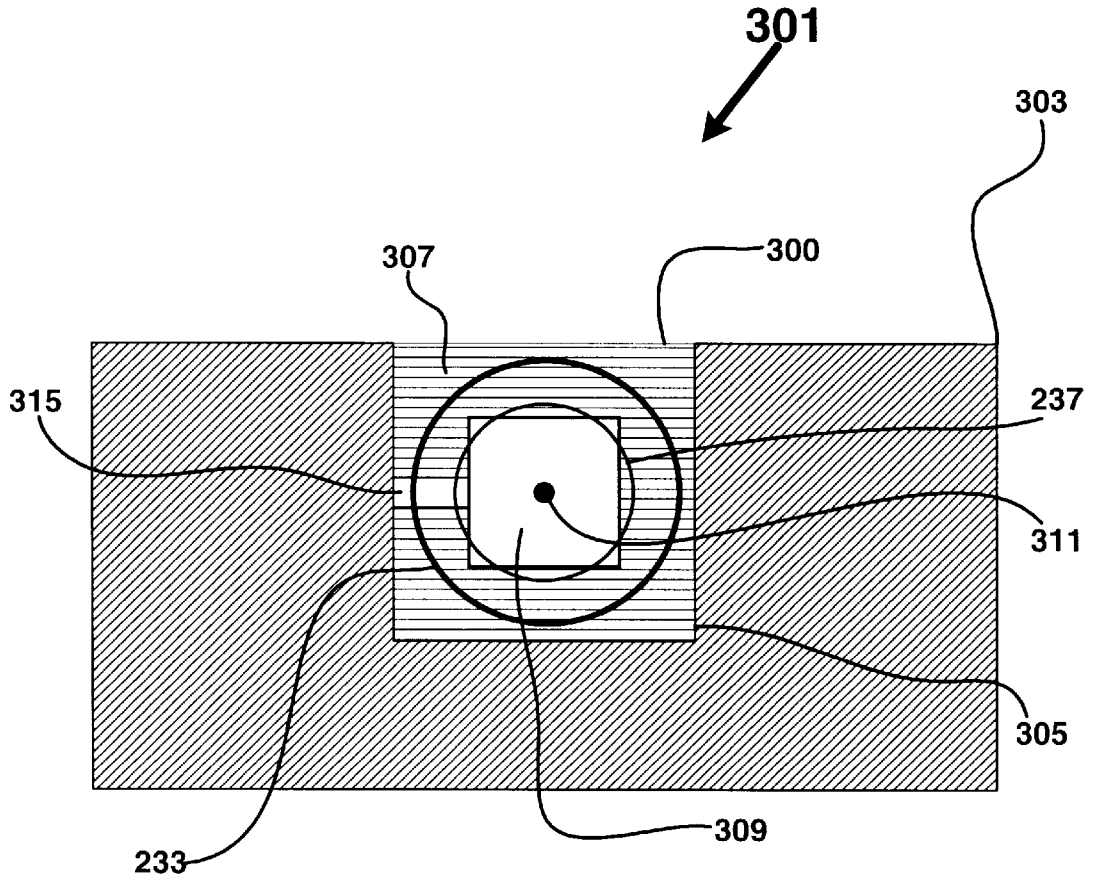
FIG. 31 is a top plan view of the taught nozzle plate and ink jet printhead of FIG. 5 and illustrates coaxial alignment of the firing element with the true bore nozzle.

Referring to FIG. 31, a top plan view of the taught nozzle plate 211 (not shown) coupled to the ink jet printhead 301 of FIG. 5 is shown. The firing axis 311 of the firing element 309 is in coaxially alignment with the input side 233 and the output side 237 of the nozzle 217 (not shown) so that ink ejected from the firing chamber 305 enters a true bore nozzle.

Another advantage of the taught nozzle plate 211 of the present invention is that the planar input surface 213 provides a flat and stable surface for mounting the printhead 301. Consequently, voids and other defects in the barrier layer 303 that can be caused by dimples or other deformations in the input surface 213 are eliminated by the planar input surface 213 of the present invention. Moreover, a flat and stable input surface 213 for mounting the printhead 301 is operative to align the firing axis 311 of the firing element 309 with the nozzle axis 241. If the nozzle 217 is not aligned with the firing axis 311 of the firing element 309, then the ejected ink bubble 313 will not enter a true bore nozzle because the input side 233 of the nozzle 217 will be offset from the firing axis and the ink bubble will not travel along a symmetric path, thereby compromising ink drop directionality.

Figure 23:
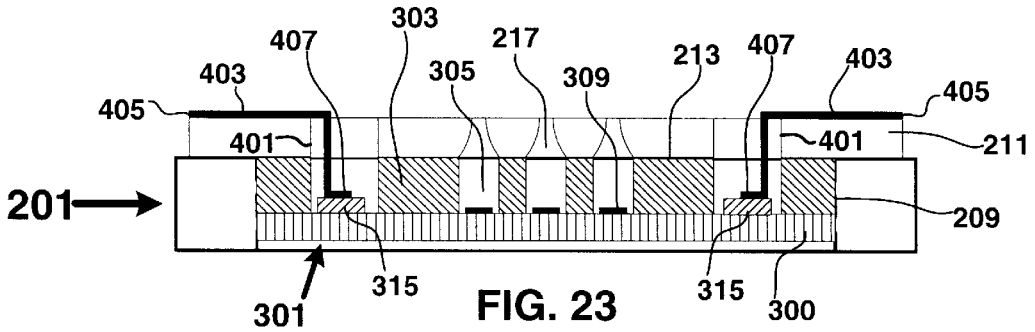
FIG. 23 is a cross-sectional view illustrating routing of the trace of FIG. 22 to a signal line of an ink jet printhead according to the present invention.
Figure 25:
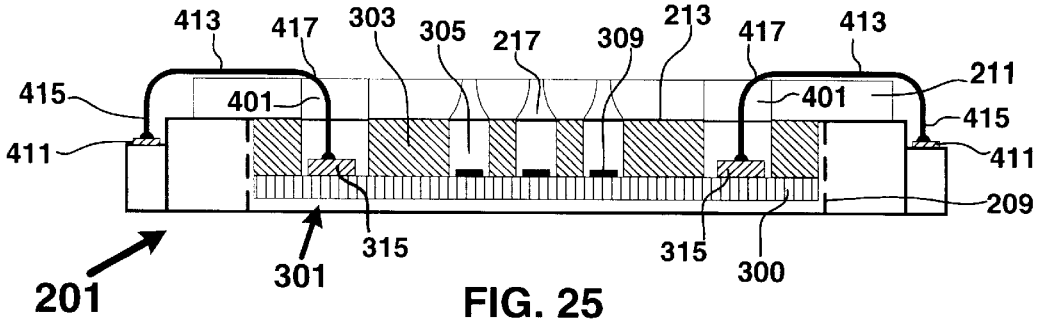
FIG. 25 is a cross-sectional view illustrating routing of a bonding wire through the feed-thru aperture of FIG. 24 according to the present invention.

In one embodiment of the present invention, as illustrated in FIGS. 23 and 25, the chip carrier 201 includes an ink jet printhead 301 positioned in the frame aperture 209 and mounted to the input side 213 of the nozzle plate 211 by a barrier layer 303 that is disposed intermediate between the printhead 301 and the input surface 213 of the nozzle plate 211.

The barrier layer 303 and the printhead 301 can have a firing chamber 305 formed therein (see FIG. 5). The firing chamber 305 includes a firing element 309 disposed in the firing chamber 305 and a fluid channel 307 for communicating ink from an ink reservoir (not shown) to the firing chamber 305. The firing chamber 305 is disposed adjacent to and in fluid communication with the input side 213 of the nozzle plate 211. The firing chamber 305 is aligned with the nozzle 217 so that a firing axis 311 of the firing element 309 is coaxially aligned with the nozzle axis 241.

The printhead 301 includes a signal line 315 that is in electrical communication with the firing element 309. The firing element 309 is operative to eject an ink drop 313 in a direction along the firing axis 311 and into the nozzle 217 thru the input side 233 of the nozzle 217 in response to a signal from a control unit (not shown) that is in electrical communication with the signal line 315. The term signal line as used herein includes a bonding pad, connector, or other electrically conductive connection disposed on the printhead 301 that electrically communicates the signal from the control unit to the firing element 309.

Alignment of the firing axis 311 to the nozzle axis 241 can be accomplished by using a tool to move the chip carrier 201 and the printhead 301 (the assembly) relative to each other in $\mu$m increments until the firing axis 311 and the nozzle axis 241 are aligned. Additionally, alignment marks can be disposed on the nozzle plate to provide a reference point for the tool. Once aligned, the printhead 301 is pressed against the nozzle plate 211 followed by applying heat and pressure to the assembly to stake the printhead 301 to the nozzle plate 211. The assembly is then placed in an oven at a high temperature to cure the barrier layer 303.

Figure 22:
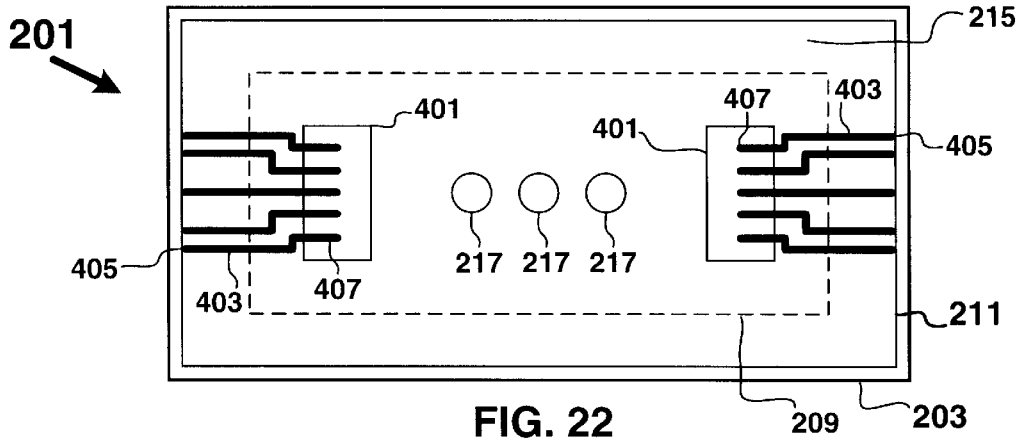
FIG. 22 is a top plan view of a nozzle plate having a feed-thru aperture and an electrically conductive trace according to the present invention.

In another embodiment of the present invention, as illustrated in FIG. 22, the chip carrier 201 includes a feed-thru aperture 401 extending between the input 213 and output 215 surfaces of the nozzle plate 211. An electrically conductive trace 403 is disposed on the output surface 215 of the nozzle plate 211. The trace 403 has a first end 405 that is in electrical communication with the control unit (not shown) and a second end 407 that is routed the feed-thru aperture 401 and is in electrical communication with the signal line 315. The trace 403 is operative to electrically communicate the signal from the control unit to the signal line 315. The feed-thru aperture 401 is positioned over the frame aperture 209 so that the signal line 315 is positioned adjacent to the feed-thru aperture 401 when the printhead 301 is mounted to the nozzle plate 211 as illustrated in FIG. 23.

The trace 403 can be made from a material such as copper or gold plated copper, for example. Compression or ultrasonic TAB bonding can be used to connect the second end 407 to the signal line 315. Referring to FIG. 23, with the ink jet printhead 301 positioned in the frame aperture 209 and mounted to the input surface 213 of the nozzle plate 211, the second end 407 is routed thru the feed-thru aperture 401 and is connected to the signal line 315. The signal line 315 can be a bonding pad, for example.

Figure 24:
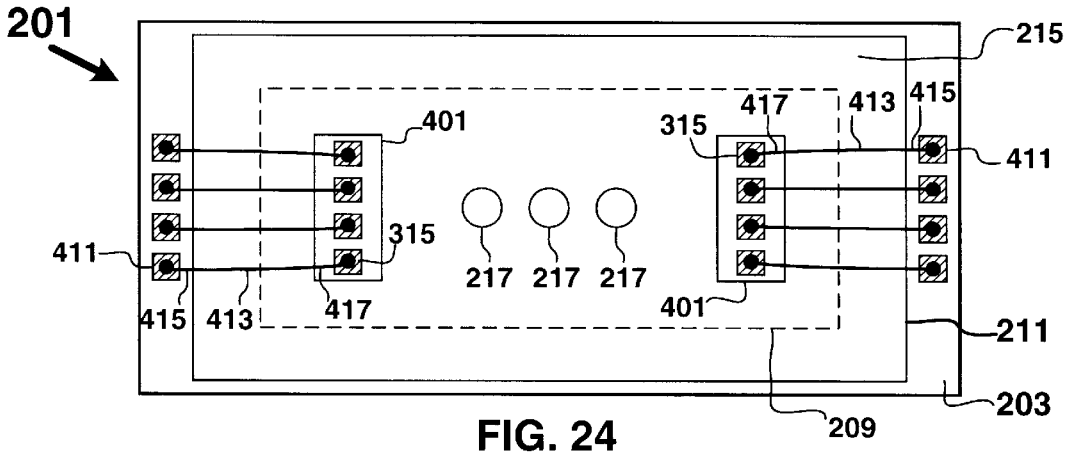
FIG. 24 is a top plan view of a nozzle plate having a feed-thru aperture and a carrier frame having a bonding pad thereon according to the present invention.

In one embodiment of the present invention, as illustrated in FIGS. 24 and 25, the chip carrier 201 includes a feed-thru aperture 401 extending between the input 213 and output 215 surfaces of the nozzle plate 211. The carrier frame 203 includes an electrically conductive bonding pad 411 that is in electrical communication with the control unit (not shown). A bonding wire 413 is routed thru the feed-thru aperture 401 and is connected at a first end 415 to the bonding pad 411 and is connected at a second end 417 to the signal line 315. The bonding wire 413 is operative to electrically communicate the signal from the control unit to the signal line 315. The bonding wire 413 should be positioned as close as possible to the output surface 215 of the nozzle plate 211 so that the output side 237 of the nozzle 217 can be positioned as close as possible to the surface of a print media.

Figure 26:
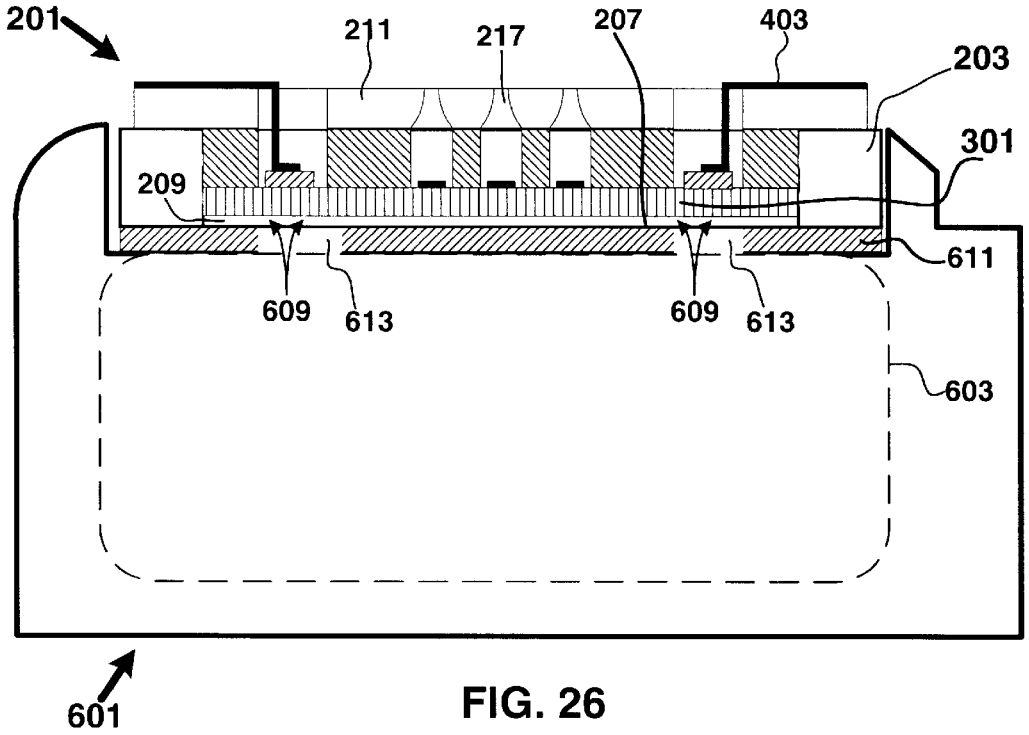
FIG. 26 is a ross-sectional view of the chip carrier of FIG. 23 mounted to a print cartridge according to the present invention.

In another embodiment of the present invention, as illustrated in FIG. 26, the chip carrier 201 of FIG. 23 or of FIG. 25 is mounted to a print cartridge 601. The print cartridge 601 has an enclosed volume that defines an ink reservoir 603 (shown in dashed outline). The base surface 207 of the carrier frame 203 is disposed on the print cartridge 601 and the frame aperture 209 is in fluid communication with the ink reservoir 603 so that ink 609 contained in the ink reservoir 603 is communicated to the ink jet printhead 301 thru the aperture frame 209. The base surface 207 can be fixedly attached to the print cartridge 601 using an adhesive 611, for example. The adhesive 611 should form a tight leak proof seal between the base surface 207 and the print cartridge 601. An ink aperture 613 can be patterned in the adhesive 611 to allow the ink 609 to enter the frame aperture 209.

It is desirable to separate the fluidic function of the nozzle plate 211 from the electronic function of the trace 403 or the bonding wire 413. By removing signal lines from the output surface 205 of the nozzle plate 211, the nozzle plate can be positioned closer to a surface to be printed, thereby reducing the distance the ink drop 313 must travel. Resulting is improved ink drop directionality. Furthermore, by separating the electrical function from the nozzle plate 211 the materials selected for the fluidic function of the nozzle plate 211 can be different than those selected for the electronic function.

Figure 17:
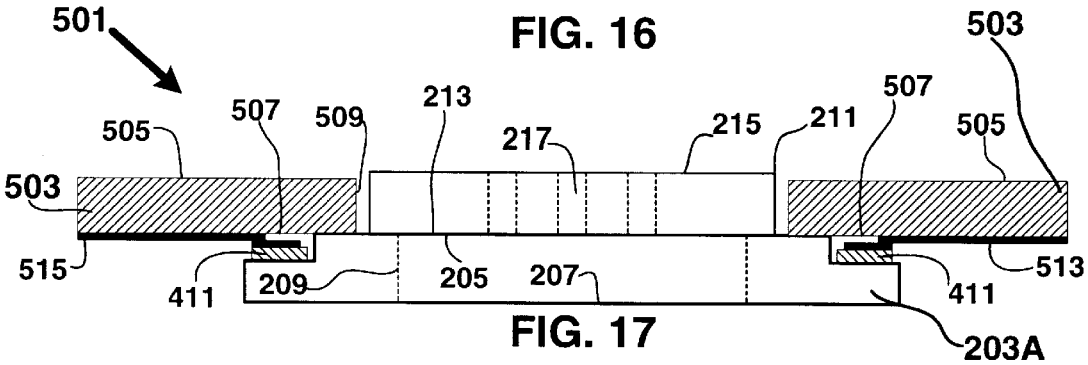
FIG. 17 is a cross-sectional view of the carrier frame of FIG. 16 mounted to the bottom side of the flex circuit of FIG. 15 with the electrically conductive traces connected to the bonding pads according to the present invention.

Accordingly, in a preferred embodiment of the present invention, as illustrated in FIG. 17, a chip carrier 501 includes a carrier frame 203A that is similar to the carrier frame 203 described above and illustrated in FIGS. 9 and 13; however, the carrier frame 203A differs from the carrier frame 203 in that it includes an electrically conductive bonding pad 411 disposed on the carrier frame 203A. Therefore, as discussed above, the chip carrier 501 includes the taught nozzle plate 211 disposed on the shelf surface 205 of the carrier frame 203A with the input side 213 disposed adjacent to the frame aperture 209 of the carrier frame 203A.

Figure 16:
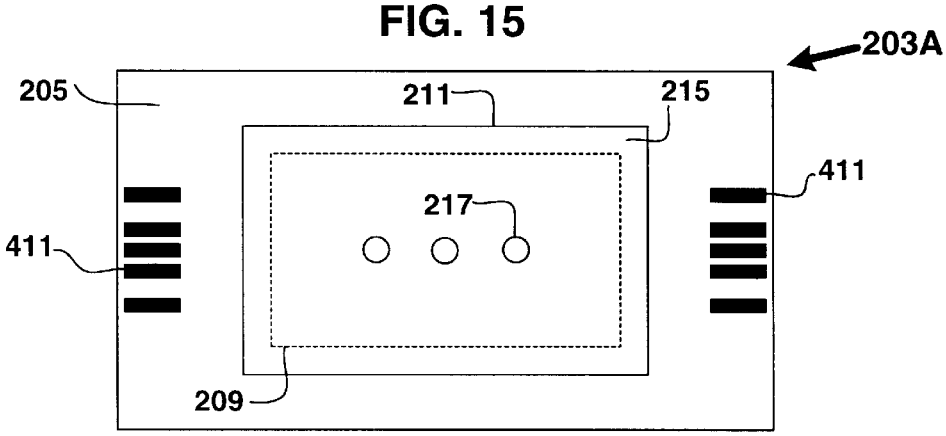
FIG. 16 is a top plan view of a carrier frame having bonding pads and a nozzle plate disposed thereon according to the present invention.

FIG. 16 is a top plan view of the carrier frame 203A showing the nozzle plate 211 mounted on the shelf surface 205. A plurality of the bonding pads 411 are shown; however, the carrier frame 203A can have only one bonding pad 411. The dimensions of the carrier frame 203A can be larger than those of the carrier frame 203 in order to accommodate the extra surface area required by the bonding pad 411. Suitable materials for the bonding pad 411 include copper and gold plated copper.

Figure 14:
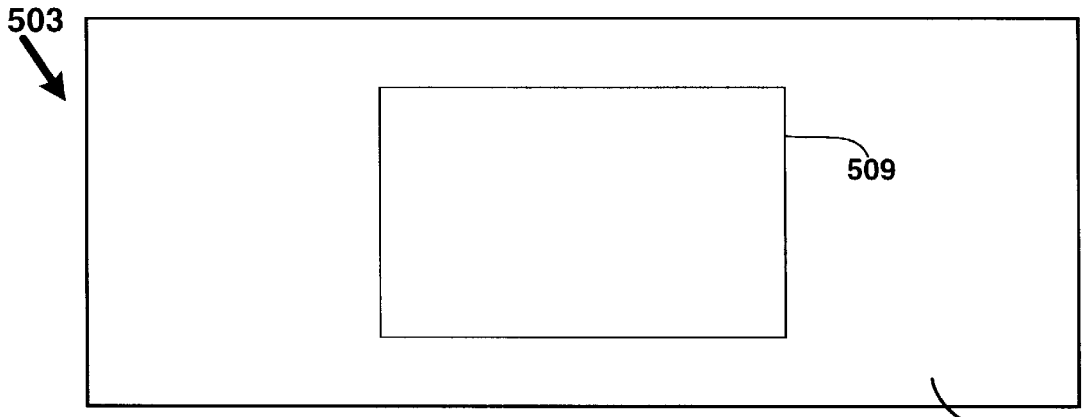
FIG. 14 is a top plan view of a front surface of a flex circuit having a nozzle aperture therein according to the present invention.

In the preferred embodiment, the chip carrier 501 separates the fluidic function of the nozzle plate 211 from the electronic function of the traces by including a flex circuit 503 as illustrated in FIG. 14. The flex circuit 503 has opposed front 505 and back 507 surfaces and a nozzle aperture 509 that extends between the front surface 505 and the back surface 507. The carrier frame 203A is mounted to the back surface 507 so that the nozzle plate 211 is disposed in the nozzle aperture 509 as will be discussed below.

Figure 15:
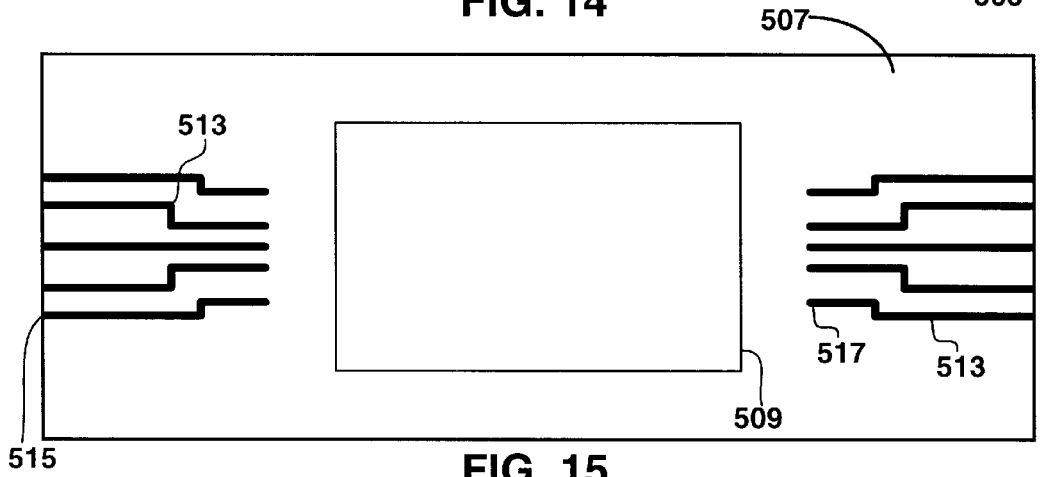
FIG. 15 is a bottom plan view illustrating electrically conductive traces disposed on a bottom surface of the flex circuit of FIG. 14 according to the present invention.

Referring to FIG. 15, in one embodiment the back surface 507 of the flex circuit 503 can include an electrically conductive trace 513 disposed on the back surface 507. The trace 513 has a terminal end 515 and a finger end 517. The terminal end 515 can be connected to a control unit (not shown) that electrically communicates print signals to an ink jet printhead (not shown) that is mounted to the carrier frame 203A, for example. The finger end 513 connects with the bonding pad 411 as will be discussed below. Suitable materials for the trace 513 include copper and gold plated copper.

Referring to FIG. 17, the shelf surface 205 of the carrier frame 203A is fixedly connected to the back surface 507 of the flex circuit 503, thereby mounting the carrier frame 203A to flex circuit 503 to form the chip carrier 501. Glue or an adhesive, for example, can be used to fixedly connected the shelf surface 205 to the back surface 507. Resulting is the nozzle plate 211 is disposed in the nozzle aperture 509 and the bonding pad 411 is positioned adjacent to the finger end 517 so that the finger end 517 of the trace 513 can be connected to the bonding pad 411. The finger end 517 can be electrically connected to the bonding pad 411 using compression or ultrasonic TAB bonding, for example.

The material for the flex circuit 503 can be polyimide film, KAPTON™, UPILEX™, and APICAL™, for example. As mentioned above in reference to the carrier frame 203 and the nozzle plate 211, the first material for the nozzle plate 211 can be polyimide film, KAPTON™, UPILEX™, and APICAL™, for example. Moreover, the second material for the carrier frame 203A can be ceramic, alumina, nickel-iron alloy, KOVAR™, and INVAR™, for example.

Consequently, in the preferred embodiment, the flex circuit 503 can be made from UPILEX™ and the nozzle plate 211 can be made from a different material such as KAPTON™, for example. On the other hand, the flex circuit 503 and the nozzle plate 211 can be made from the same material. For instance, they both can be made from UPILEX™ or the both can be made from KAPTON™.

In the preferred embodiment, the nozzle plate 211 has the thickness 220 (see FIG. 5) from about 12.70 $\mu$m to about 152.40 $\mu$m, and more preferably from about 25.40 $\mu$m to about 127.00 $\mu$m.

As previously mentioned, the nozzle plate 211 is made from the first material having the first thermal expansion coefficient and the carrier frame 203A is made from the second material having the second thermal expansion coefficient. The second thermal expansion coefficient of the carrier frame 203A is less than the first thermal expansion coefficient of the nozzle plate 211. The dissimilarity between the first and second thermal expansion coefficients is operative to generate the tensile stress on the nozzle plate 211.

The first thermal expansion coefficient for the nozzle plate 211 is in a range from about 12.00 ppm/°C. to about 25.00 ppm/°C. The second thermal expansion coefficient for the carrier frame 203A is in a range from about 3.00 ppm/°C. to about 11.00 ppm/°C.

The tensile stress on the nozzle plate 211 is in a range from about 6.50 Mpa to about 140.0 Mpa. The actual tensile stress acting on the nozzle plate 211 can vary with temperature. However, the above range represents the range of tensile stress at about room temperature.

Figure 18:
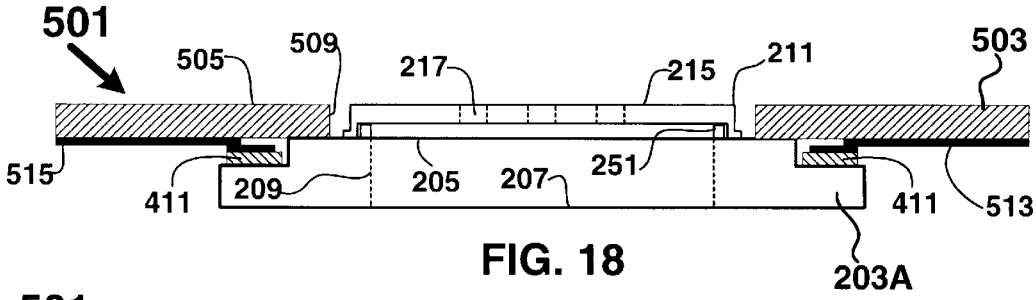
FIG. 18 is a cross-sectional view of a carrier frame mounted to the bottom side of a flex circuit and having a nozzle plate disposed on a lip portion according to the present invention.

The chip carrier 501 can include the lip 251 disposed on the shelf surface 205 with the nozzle plate 211 disposed on the planar upper surface 253 as illustrated in FIG. 18. As discussed above the lip 251 provides a flat reference plane for the nozzle plate 211.

The nozzle 217 can have converging sidewall surfaces 219*b* that converge in a direction toward the output side 237 of the nozzle 217 as illustrated in FIG. 29. More preferably, the nozzle 217 has converging sidewall surfaces 219*c* that are arcuate in shape and converge in a direction toward the output side 237 of the nozzle 217 as illustrated in FIG. 30. The NCA 247 of the nozzle 217 deviates from coaxial alignment with the nozzle axis 241 by no more than about 1.0 degrees (see FIG. 5).

Figure 19:
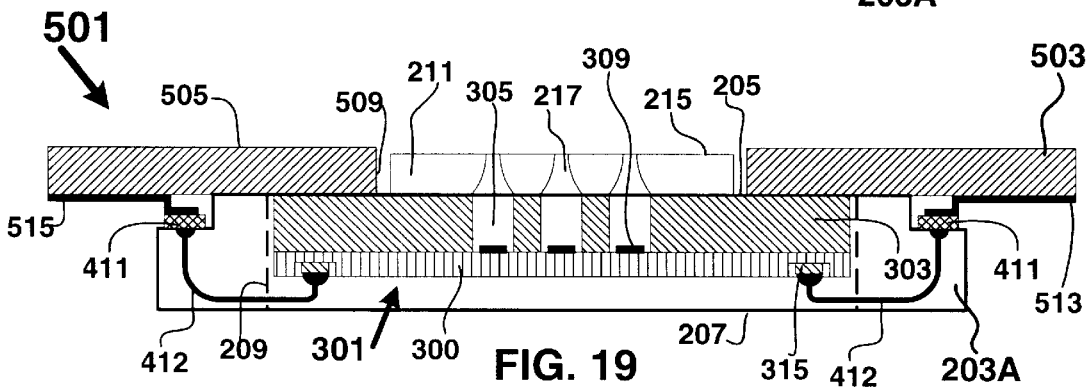
FIG. 19 is a cross-sectional view of the carrier frame and flex circuit of FIG. 17 with an ink jet printhead mounted to the nozzle plate and bonding wires connecting signal lines on the printhead to the bonding pads according to the present invention.
Figure 20:
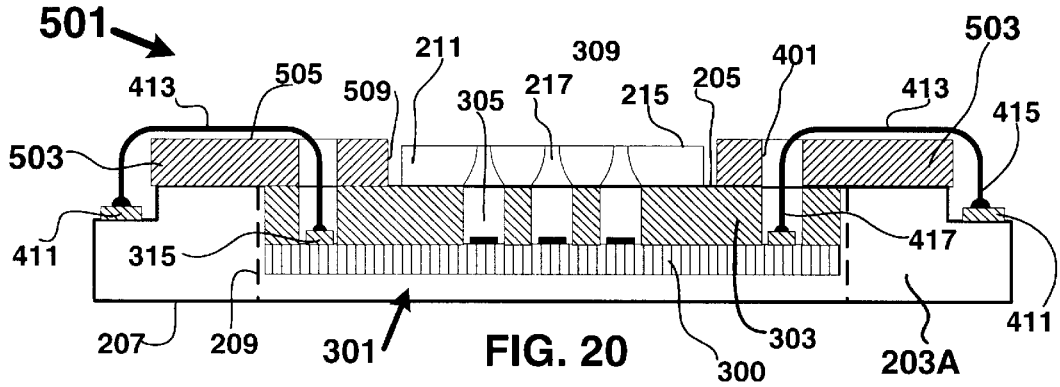
FIG. 20 is a side plan view of a flex circuit having a feed-thru aperture for routing of bonding wires to a signal line according to the present invention.

In one embodiment of the present invention, as illustrated in FIGS. 19 and 20, the chip carrier 501 includes an ink jet printhead 301 positioned in the frame aperture 209 and mounted to the input side 213 of the nozzle plate 211 by a barrier layer 303 that is disposed intermediate between the printhead 301 and the input surface 213 of the nozzle plate 211.

The barrier layer 303 and the printhead 301 can have a firing chamber 305 formed therein (see FIG. 5). The firing chamber 305 includes a firing element 309 disposed in the firing chamber 305 and a fluid channel 307 for communicating ink from an ink reservoir (not shown) to the firing chamber 305. The firing chamber 305 is disposed adjacent to and in fluid communication with the input side 213 of the nozzle plate 211. The firing chamber 305 is aligned with the nozzle 217 so that a firing axis 311 of the firing element 309 is coaxially aligned with the nozzle axis 241.

The printhead 301 includes a signal line 315 that is in electrical communication with the firing element 309. The firing element 309 is operative to eject an ink drop 313 in a direction along the firing axis 311 and into the nozzle 217 thru the input side 233 of the nozzle 217 in response to a signal from a control unit (not shown) that is in electrical communication with the signal line 315. The term signal line as used herein includes a bonding pad, connector, or other electrically conductive connection disposed on the printhead 301 that electrically communicates the signal from the control unit to the firing element 309.

In FIG. 19, a bonding wire 412 having first end in electrical communication with the bonding pad 411 and a second end in electrical communication with the signal line 315. The bonding wire 412 is operative to communicate the signal present at the terminal end 515 of the trace 413 to the signal line 315.

Figure 21:
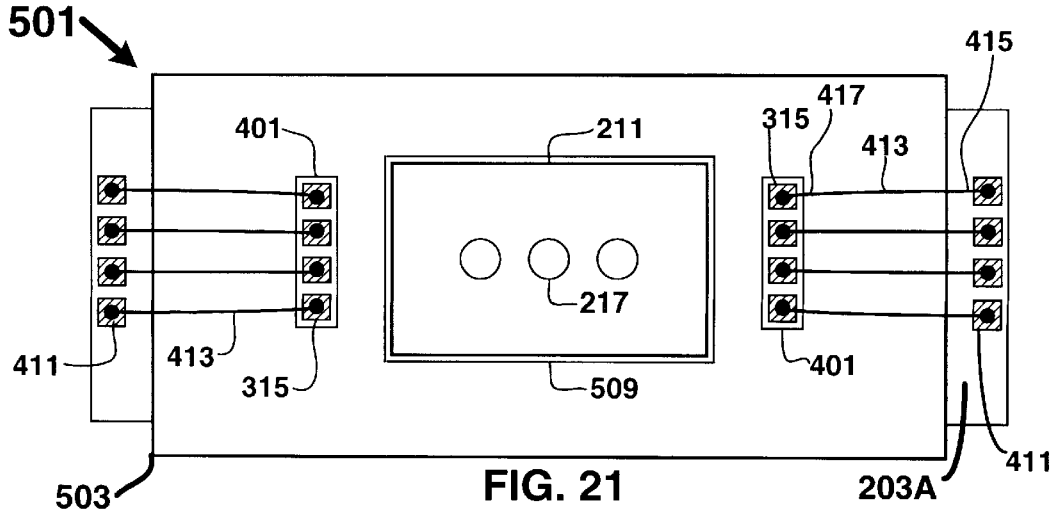
FIG. 21 is a top plan view of the feed-thru aperture and bonding pads of FIG. 20 according to the present invention.

In one embodiment of the present invention, as illustrated in FIG. 21, the flex circuit 503 of the chip carrier 501 includes a feed-thru aperture that extends between the front surface 505 and the back surface 507. A bonding wire 413 having a first end 415 connected to the bonding pad 411 and a second end 417 connected to the signal line 315 is routed through the feed-thru aperture 401 and is operative to electrically communicate the signal from the bonding pad 411 to the signal line 315. FIG. 20 is top view of the routing of the bonding wire 413 through the feed-thru aperture 401 of the flex circuit 503.

Figure 27:
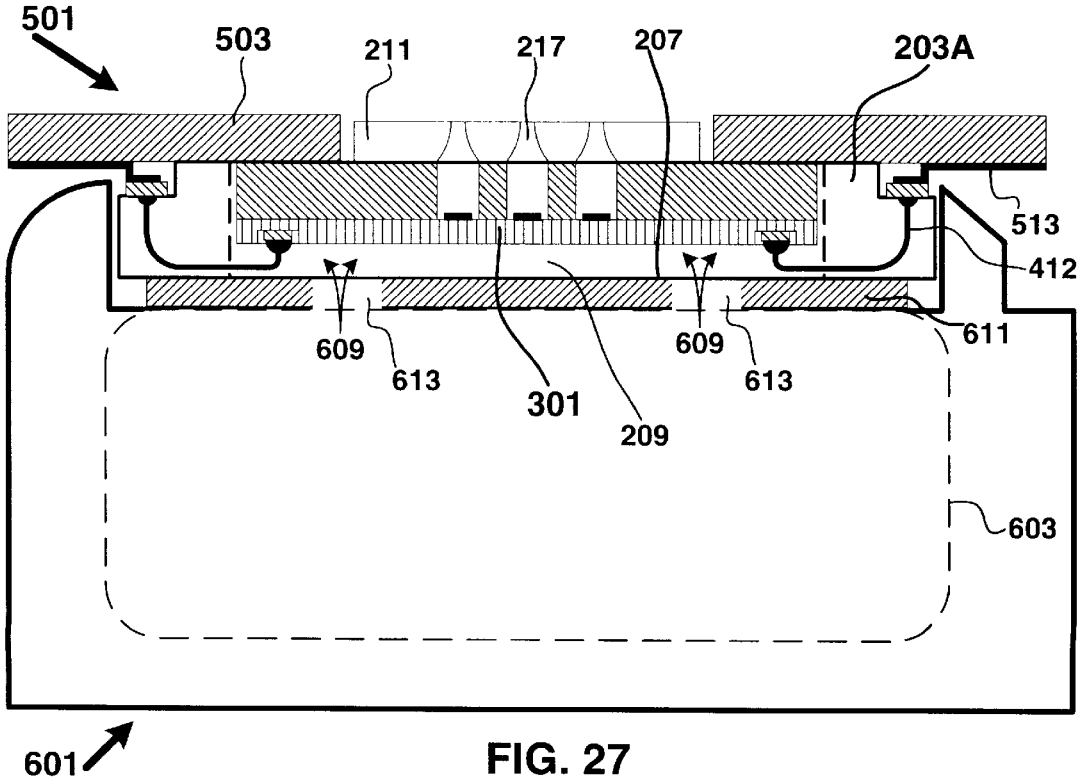
FIG. 27 is a side view of the chip carrier of FIG. 19 mounted to a print cartridge according to the present invention.

In another embodiment of the present invention, as illustrated in FIG. 27, the chip carrier 501 of FIG. 19 or of FIG. 20 is mounted to a print cartridge 601. The print cartridge 601 has an enclosed volume that defines an ink reservoir 603 (shown in dashed outline). The base surface 207 of the carrier frame 203 is disposed on the print cartridge 601 and the frame aperture 209 is in fluid communication with the ink reservoir 603 so that ink 609 contained in the ink reservoir 603 is communicated to the ink jet printhead 301 thru the aperture frame 209. The base surface 207 can be fixedly attached to the print cartridge 601 using an adhesive 611, for example. The adhesive 611 should form a tight leak proof seal between the base surface 207 and the print cartridge 601. An ink aperture 613 can be patterned in the adhesive 611 to allow the ink 609 to enter the frame aperture 209.

Although several embodiments of the present invention have been disclosed and illustrated, the invention is not limited to the specific forms or arrangements of parts so described and illustrated. The invention is only limited by the claims.

What is claimed is:

1. A chip carrier, comprising:

a carrier frame having opposed shelf and base surfaces and a frame aperture extending between the opposed surfaces;

a nozzle plate having opposed input and output surfaces and at least one nozzle formed by sidewall surfaces extending between the input and output surfaces, the nozzle has a nozzle camber angle measured relative to a nozzle axis and defined by an angular displacement between a center point of symmetry on an input side of the nozzle and a center point of symmetry on an output side of the nozzle, the nozzle plate is disposed on the shelf surface of the carrier frame with the input surface positioned adjacent to the frame aperture and the nozzle plate is fixedly connected to at least one pair of opposing sides of the shelf surface, the nozzle plate is characterized by being disposed on the shelf surface in a state of tensile stress so that the input and output surfaces of the nozzle plate are taught, planar, and parallel to each other, the tensile stress on the nozzle plate is operative to symmetrically dispose the sidewall surfaces of the nozzle about the nozzle axis and to align the center points of symmetry of the input and output sides of the nozzle with the nozzle axis so that the nozzle camber angle is substantially 0.0 degrees and is coaxially aligned with the nozzle axis, and wherein a fluid injected into the nozzle thru the input side exits the nozzle from the output side with a fluid trajectory that substantially matches the nozzle camber angle.

2. The chip carrier of claim 1, wherein the nozzle plate comprises a first material having a first thermal expansion coefficient and the carrier frame comprises a second material having a second thermal expansion coefficient, the second thermal expansion coefficient is less than the first thermal expansion coefficient, and wherein dissimilarity between the first and second thermal expansion coefficients is operative to generate the tensile stress on the nozzle plate.

3. The chip carrier of claim 2, wherein the first thermal expansion coefficient is in a range from about 12.00 ppm/°C. to about 25.00 ppm/°C. and the second thermal expansion coefficient is in a range from about 3.00 ppm/°C. to about 11.00 ppm/°C.

4. The chip carrier of claim 2, wherein the first material is a material selected from the group consisting of polyimide film, KAPTON, UPILEX, and APICAL, and the second material is a material selected from the group consisting of ceramic, alumina, nickel-iron alloy, KOVAR, and INVAR.

5. The chip carrier of claim 1, wherein the nozzle has converging sidewall surfaces and the sidewall surfaces converge in a direction toward the output side of the nozzle.

6. The chip carrier of claim 5, wherein the converging sidewall surfaces are arcuate in shape.

7. The chip carrier of claim 1, wherein the nozzle plate has a thickness from about 12.70 $\mu$m to about 152.40 $\mu$m.

8. The chip carrier of claim 7, wherein the thickness of the nozzle plate is from about 25.40 μm to about 127.00 μm.

9. The chip carrier of claim 1, wherein the nozzle plate is fixedly connected to the shelf surface by an adhesive disposed intermediate between the shelf surface and the input surface of the nozzle plate.

10. The chip carrier of claim 1, wherein the shelf surface includes a raised portion defining a lip, the lip extends outward of the shelf surface and terminates in a planar upper surface, the input surface of the nozzle plate is disposed on the upper surface of the lip and the nozzle plate is fixedly connected to the shelf surface by an adhesive disposed intermediate between the shelf surface and the input surface of the nozzle plate, and wherein the lip is operative to provide a flat reference plane for the nozzle plate, whereby planarity of the nozzle plate is not compromised by non-uniform thickness of the adhesive.

11. The chip carrier of claim 1, wherein the nozzle camber angle deviates from coaxial alignment with the nozzle axis by no more than about 1.0 degrees.

12. The chip carrier of claim 1, wherein the tensile stress on the nozzle plate is in a range from about 6.50 Mpa to about 140.00 Mpa.

13. The chip carrier of claim 1, and further comprising:

an ink jet printhead positioned in the frame aperture and mounted to the input surface of the nozzle plate by a barrier layer disposed intermediate between the ink jet printhead and the input surface of the nozzle plate.

14. The chip carrier of claim 13, wherein the barrier layer and the ink jet printhead have a firing chamber formed therein, and the firing chamber includes a firing element disposed in the firing chamber and a fluid channel for communicating ink from an ink reservoir to the firing chamber, the firing chamber is disposed adjacent to and in fluid communication with the input side of the nozzle so that a firing axis of the firing element is coaxially aligned with the nozzle axis, the printhead includes a signal line in electrical communication with the firing element, and wherein the firing element is operative to eject an ink drop from the firing chamber in a direction along the firing axis and into the nozzle thru the input side of the nozzle in response to a signal from control unit in electrical communication with the signal line.

15. The chip carrier of claim 14 and further comprising:

a feed-thru aperture extending between the input and output surfaces of the nozzle plate;

an electrically conductive bonding pad disposed on the carrier frame and in electrical communication with the control unit; and a bonding wire, the bonding wire routed thru the feed-thru aperture and connected at a first end to the bonding pad and connected at a second end to the signal line, the bonding wire operative to electrically communicate the signal from the bonding pad to the signal line.

16. The chip carrier of claim 14 and further comprising:

a feed-thru aperture extending between the input and output surfaces of the nozzle plate; and an electrically conductive trace disposed on the output surface of the nozzle plate, the trace having a first end in electrical communication with the control unit and a second end that is routed thru the feed-thru aperture and is in electrical communication with the signal line, the trace is operative to electrically communicate the signal from the control unit to the signal line.

17. The chip carrier of claim 13, wherein the carrier frame is mounted on a print cartridge having an enclosed volume that defines an ink reservoir, the base surface of the carrier frame is disposed on the print cartridge and the frame aperture is in fluid communication with the ink reservoir whereby ink contained in the reservoir is communicated to the ink jet printhead thru the frame aperture.

18. A chip carrier, comprising:

a carrier frame having opposed shelf and base surfaces and a frame aperture extending between the opposed surfaces, the carrier frame includes an electrically conductive bonding pad disposed thereon;

a flex circuit having opposed front and back surfaces and a nozzle aperture extending between the front and back surfaces;

a nozzle plate having opposed input and output surfaces and at least one nozzle formed by sidewall surfaces extending between the input and output surfaces, the nozzle has a nozzle camber angle measured relative to a nozzle axis and defined by an angular displacement between a center point of symmetry on an input side of the nozzle and a center point of symmetry on an output side of the nozzle, the nozzle plate is disposed on the shelf surface of the carrier frame with the input surface positioned adjacent to the frame aperture and the nozzle plate is fixedly connected to at least one pair of opposing sides of the shelf surface, the nozzle plate is characterized by being disposed on the shelf surface in a state of tensile stress so that the input and output surfaces of the nozzle plate are taught, planar, and parallel to each other, the tensile stress on the nozzle plate is operative to symmetrically dispose the sidewall surfaces of the nozzle about the nozzle axis and to align the center points of symmetry of the input and output sides of the nozzle with the nozzle axis so that the nozzle camber angle is substantially 0.0 degrees and is coaxially aligned with the nozzle axis, wherein a fluid injected into the nozzle thru the input side exits the nozzle from the output side with a fluid trajectory that substantially matches the nozzle camber angle; and the shelf surface of the carrier frame is fixedly connected to the back surface of the flex circuit so that the nozzle plate is disposed in the nozzle aperture.

19. The chip carrier of claim 18, wherein the nozzle plate comprises a first material having a first thermal expansion coefficient and the carrier frame comprises a second material having a second thermal expansion coefficient, the second thermal expansion coefficient is less than the first thermal expansion coefficient, and wherein dissimilarity between the first and second thermal expansion coefficients is operative to generate the tensile stress on the nozzle plate.

20. The chip carrier of claim 19, wherein the first thermal expansion coefficient is in a range from about 12.00 ppm/°C. to about 25.00 ppm/°C. and the second thermal expansion coefficient is in a range from about 3.00 ppm/°C. to about 11.00 ppm°C.

21. The chip carrier of claim 19, wherein the first material is a material selected from the group consisting of polyimide film, KAPTON, UPILEX, and APICAL, and the second material is a material selected from the group consisting of ceramic, alumina, nickel-iron alloy, KOVAR, and INVAR.

22. The chip carrier of claim 18, wherein the flex circuit is a material selected from the group consisting of polyimide film, KAPTON, UPILEX, and APICAL.

23. The chip carrier of claim 18, wherein the nozzle has converging sidewall surfaces and the sidewall surfaces converge in a direction toward the output side of the nozzle.

24. The chip carrier of claim 23, wherein the converging sidewall surfaces are arcuate in shape.

25. The chip carrier of claim 18, wherein the nozzle plate has a thickness from about 12.70 $\mu$m to about 152.40 $\mu$m.

26. The chip carrier of claim 25, wherein the thickness of the nozzle plate is from about 25.40 $\mu$m to about 127.00 $\mu$m.

27. The chip carrier of claim 18, wherein the nozzle plate is fixedly connected to the shelf surface by an adhesive disposed intermediate between the shelf surface and the input surface of the nozzle plate.

28. The chip carrier of claim 18, wherein the shelf surface includes a raised portion defining a lip, the lip extends outward of the shelf surface and terminates in a planar upper surface, the input surface of the nozzle plate is disposed on the upper surface of the lip and the nozzle plate is fixedly connected to the shelf surface by an adhesive disposed intermediate between the shelf surface and the input surface of the nozzle plate, and wherein the lip is operative to provide a flat reference plane for the nozzle plate, whereby planarity of the nozzle plate is not compromised by non-uniform thickness of the adhesive.

29. The chip carrier of claim 18, wherein the nozzle camber angle deviates from coaxial alignment with the nozzle axis by no more than about 1.0 degrees.

30. The chip carrier of claim 18, wherein the tensile stress on the nozzle plate is in a range from about 6.50 Mpa to about 140.00 Mpa.

31. The chip carrier of claim 18, and further comprising:

an ink jet printhead positioned in the frame aperture and mounted to the input surface of the nozzle plate by a barrier layer disposed intermediate between the ink jet printhead and the input surface of the nozzle plate.

32. The chip carrier of claim 31, wherein the barrier layer and the ink jet printhead have a firing chamber formed therein, and the firing chamber includes a firing element disposed in the firing chamber and a fluid channel for communicating ink from an ink reservoir to the firing chamber, the firing chamber is disposed adjacent to and in fluid communication with the input side of the nozzle so that a firing axis of the firing element is coaxially aligned with the nozzle axis, the printhead includes a signal line that is in electrical communication with the firing element and the bonding pad, and wherein the firing element is operative to eject an ink drop from the firing chamber in a direction along the firing axis and into the nozzle thru the input side of the nozzle in response to a signal from a control unit in electrical communication with the bonding pad.

33. The chip carrier of claim 32 and further comprising:

an electrically conductive trace disposed on the back surface of the flex circuit, the trace having a terminal end in electrical communication with the control unit and a finger end that is in electrical communication with the bonding pad; and a bonding wire having a first end in electrical communication with the bonding pad and a second end in electrical communication with the signal line.

34. The chip carrier of claim 32 and further comprising:

a feed-thru aperture extending between the front and back surfaces of the flex circuit; and a bonding wire, the bonding wire routed thru the feed-thru aperture and connected at a first end to the bonding pad and connected at a second end to the signal line, the bonding wire operative to electrically communicate the signal from the bonding pad to the signal line.

35. The chip carrier of claim 31, wherein the chip carrier is mounted on a print cartridge having an enclosed volume that defines an ink reservoir, the base surface of the carrier frame is disposed on the print cartridge and the frame aperture is in fluid communication with the ink reservoir whereby ink contained in the reservoir is communicated to the ink jet printhead thru the frame aperture.

* * * * *